US008862011B2

(12) United States Patent
Shida et al.

(10) Patent No.: US 8,862,011 B2
(45) Date of Patent: Oct. 14, 2014

(54) IMAGE FORMING APPARATUS HAVING TEST IMAGE FORMATION

(71) Applicant: Canon Kabushiki Kaisha, Tokyo (JP)

(72) Inventors: Tomonori Shida, Mishima (JP); Shun-ichi Ebihara, Suntou-gun (JP); Hiroshi Kita, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 44 days.

(21) Appl. No.: 13/628,241

(22) Filed: Sep. 27, 2012

(65) Prior Publication Data

US 2013/0114968 A1 May 9, 2013

(30) Foreign Application Priority Data

Sep. 30, 2011 (JP) ..... 2011-218720

(51) Int. Cl.
*G03G 15/00* (2006.01)
*G03G 15/16* (2006.01)

(52) U.S. Cl.
CPC ..... *G03G 15/16* (2013.01); *G03G 15/5058* (2013.01); *G03G 15/1605* (2013.01)
USPC ..... 399/72

(58) Field of Classification Search
USPC ..... 399/72, 49
See application file for complete search history.

(56) References Cited

U.S. PATENT DOCUMENTS

| | | | | |
|---|---|---|---|---|
| 7,469,991 | B2 | 12/2008 | Suzuki et al. | |
| 2003/0138261 | A1 * | 7/2003 | Tezuka et al. | 399/49 |
| 2005/0276620 | A1 * | 12/2005 | Omata | 399/49 |
| 2006/0227202 | A1 * | 10/2006 | Suzuki et al. | 347/132 |
| 2007/0014610 | A1 * | 1/2007 | Carter et al. | 399/401 |
| 2007/0065200 | A1 * | 3/2007 | Asaba | 399/394 |
| 2007/0189789 | A1 * | 8/2007 | Suzuki | 399/49 |

(Continued)

FOREIGN PATENT DOCUMENTS

| | | | | |
|---|---|---|---|---|
| JP | 2001-109219 A | | 4/2001 | |
| JP | 2001109219 A | * | 4/2001 | G03G 15/01 |

(Continued)

OTHER PUBLICATIONS

Hiroshi Kita et al., U.S. Appl. No. 13/686,156, filed Nov. 27, 2012.

*Primary Examiner* — G. M. Hyder

(74) *Attorney, Agent, or Firm* — Fitzpatrick, Cella, Harper & Scinto

(57) ABSTRACT

An image forming apparatus includes an image bearing member configured to bear an image with a toner, a transfer unit configured to transfer the image from the image bearing member onto a recording material, a conveying unit configured to convey the recording material having the image on a first side thereof to transfer the image onto a second side of the recording material, and a control unit configured to control an operation for forming a test image in an interval region between a first image, formed on the image bearing member, and a second image formed subsequently to the first image on the image bearing member. The control unit is configured to permit formation of the test image in the image interval region when the second image is an image to be transferred onto a first side of the recording material and configured to prevent formation of the test image in the image interval region when the second image is an image to be transferred onto a second side of the recording material.

19 Claims, 14 Drawing Sheets

(56) References Cited

U.S. PATENT DOCUMENTS

| | | | | |
|---|---|---|---|---|
| 2008/0019739 | A1* | 1/2008 | Oouchi | 399/301 |
| 2008/0019740 | A1* | 1/2008 | Oouchi | 399/301 |
| 2009/0245828 | A1* | 10/2009 | Ito | 399/49 |
| 2012/0230712 | A1* | 9/2012 | Suzuki et al. | 399/49 |
| 2013/0136473 | A1* | 5/2013 | Kita et al. | 399/49 |

FOREIGN PATENT DOCUMENTS

| | | | |
|---|---|---|---|
| JP | 2001-240690 | A | 9/2001 |
| JP | 2006-292824 | A | 10/2006 |
| JP | 2006292824 | A * | 10/2006 |

* cited by examiner

IMAGE FORMING APPARATUS HAVING TEST IMAGE FORMATION

FIELD OF THE INVENTION AND RELATED ART

The present invention relates to an image forming apparatus of an electrophotographic type, such as a copying machine, a printer or a facsimile machine.

In a conventional image forming apparatus, a density of a patch image experimentally formed with a toner (hereinafter also simply referred to as a "patch") is read and then an image forming condition is adjusted.

As an image density adjusting method which places importance on productivity, a method in which a density of a patch formed at a so-called sheet interval (hereinafter referred also as a "sheet interval patch") is read and then a density fluctuation during printing is adjusted in real time has been known (Japanese Laid-Open Patent Application (JP-A) 2001-109219). The sheet interval refers to timing between a page and a subsequent page during a print job of a plurality of pages, i.e., a period (interval) between an image and a subsequent image during continuous image form. Further, the print job refers to a series of image forming operations of a single sheet of or a plurality of sheets of a recording material in accordance with a single print command (instruction).

As the image forming apparatus of the electrophotographic type, there is an image forming apparatus of an intermediary transfer type in which toner images are successively primary-transferred superposedly onto an intermediary transfer member and then are collectively secondary-transferred onto the recording material. As the intermediary transfer member, an endless intermediary transfer belt is used in general. Further, as a secondary transfer means for transferring the toner images from the intermediary transfer belt onto the recording material, a secondary transfer roller which is a roller-type secondary transfer member rotating in contact with the intermediary transfer belt has been widely used. In the case where sheet interval density adjusting is performed in the image forming apparatus of the intermediary transfer type, the sheet interval patch is formed on the intermediary transfer belt.

In the sheet interval density adjusting in the image forming apparatus of the intermediary transfer type, the sheet interval patch transferred onto the intermediary transfer belt passes through a secondary transfer portion where the intermediary transfer belt and the secondary transfer roller contact each other. At this time, there is a possibility that a part of the toner of the sheet interval density adjusting is transferred onto a surface of the secondary transfer roller and thus the surface of the secondary transfer roller is contaminated with the toner. When the surface of the secondary transfer roller is contaminated with the toner, the toner is deposited on a print, so that there is a possibility that an image quality is lowered.

In order to solve such a problem, there is a method in which the secondary transfer roller is spaced from the intermediary transfer belt at the sheet interval in order to originally prevent the secondary transfer roller from being contaminated with the toner. However, in this method, it takes time to perform an operation for moving the secondary transfer roller away from and toward the intermediary transfer belt, and therefore this method is disadvantageous from the viewpoint of the productivity.

Further, there is a method in which an AC electric field is formed at the secondary transfer portion after the toner passes through the secondary transfer portion, and thus the toner deposited on the secondary transfer roller is transferred back to the intermediary transfer belt to prevent contamination of the secondary transfer roller with the toner. However, also this method requires a time for completing a necessary operation, thus being unpreferable from the viewpoint of the productivity.

Further, the above-described problem is not limited to the secondary transfer roller but is also true for a rotatable member which is contaminated with the toner.

SUMMARY OF THE INVENTION

A principal object of the present invention is to provide an image forming apparatus capable of improving productivity and density stability while suppressing contamination of a recording material (print) with a test image formed between an image and a subsequent image during continuous image formation.

According to an aspect of the present invention, there is provided an image forming apparatus comprising: an image bearing member capable of bearing a toner image; a rotatable transfer member for transferring the toner image from the image bearing member onto a recording material while nip-feeding the recording material between itself and the image bearing member at a transfer portion; conveying means for conveying the recording material having the toner image on a first side thereof to transfer the toner image onto a second side of the recording material; control means for controlling an operation for forming a test toner image on the image bearing member in an interval region between consecutive output images during continuous image formation for successively forming the output images; detecting means for detecting the test image, wherein the control means permits the formation of the test image, when next one of the consecutive output images is to be transferred onto a first side of the recording material, and the control means is capable of preventing the formation of the test image, when next one of the consecutive output images is to be transferred onto a second side of the recording material.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, an image forming apparatus according to the present invention will be specifically described with reference to the drawings. However, dimensions, materials, shapes, relative arrangements and the like of constituent elements described in the following embodiments should be appropriately modified depending on constitutions or various conditions of image forming apparatuses to which the present invention is applied. Therefore, the scope of the present invention is not limited to the following embodiments.

Embodiment 1

1. General Structure and Operation of Image Forming Apparatus

Figure 1:
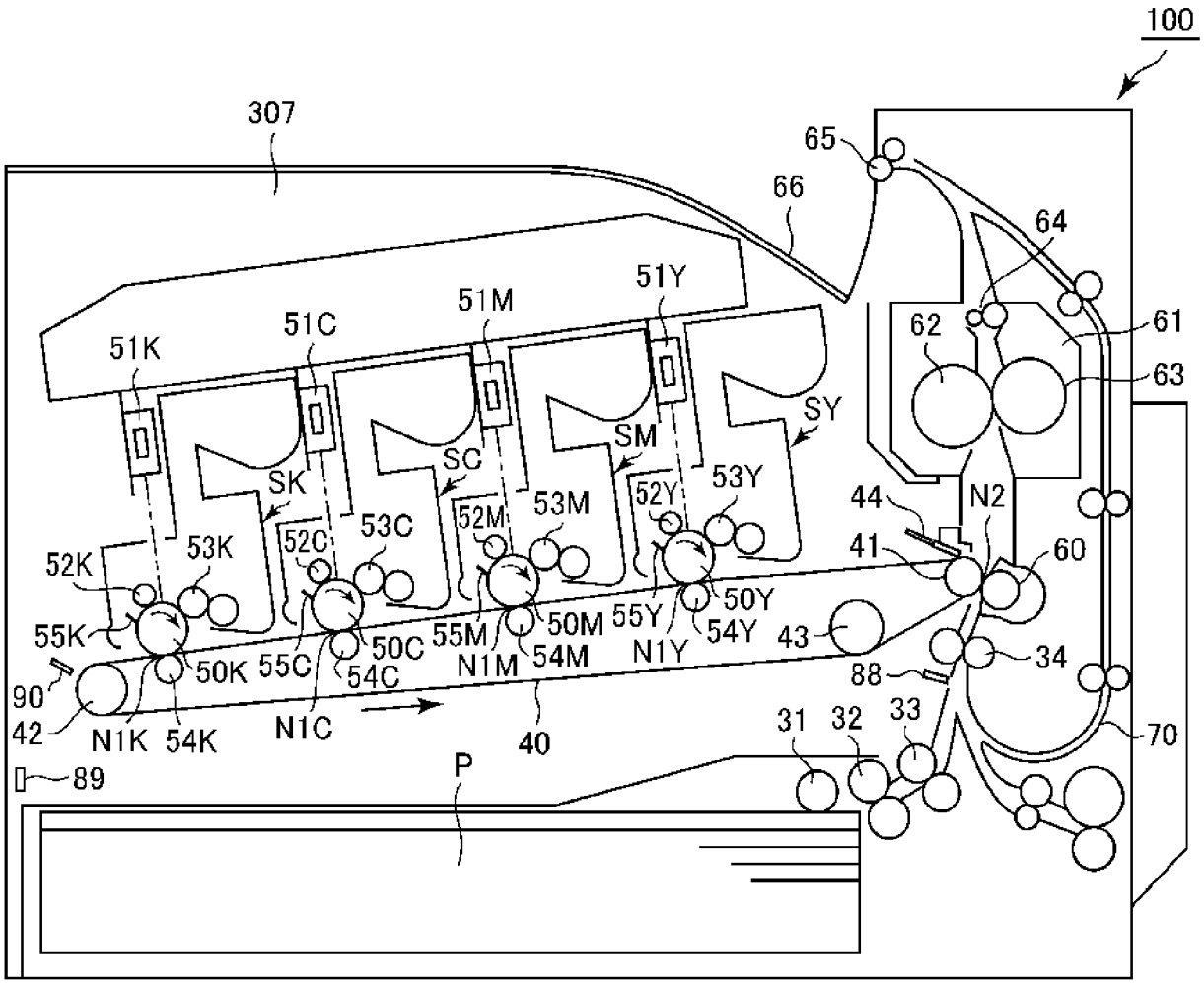
FIG. 1 is a sectional view showing a general structure of an image forming apparatus.

FIG. 1 is a sectional view showing a general structure of an image forming apparatus 100 in this embodiment according to the present invention. The image forming apparatus 100 in this embodiment is an A3 size-compatible laser beam printer of a tandem type employing an intermediary transfer type in which a full-color image is capable of being formed by using an electrophotographic type.

Figure 2:
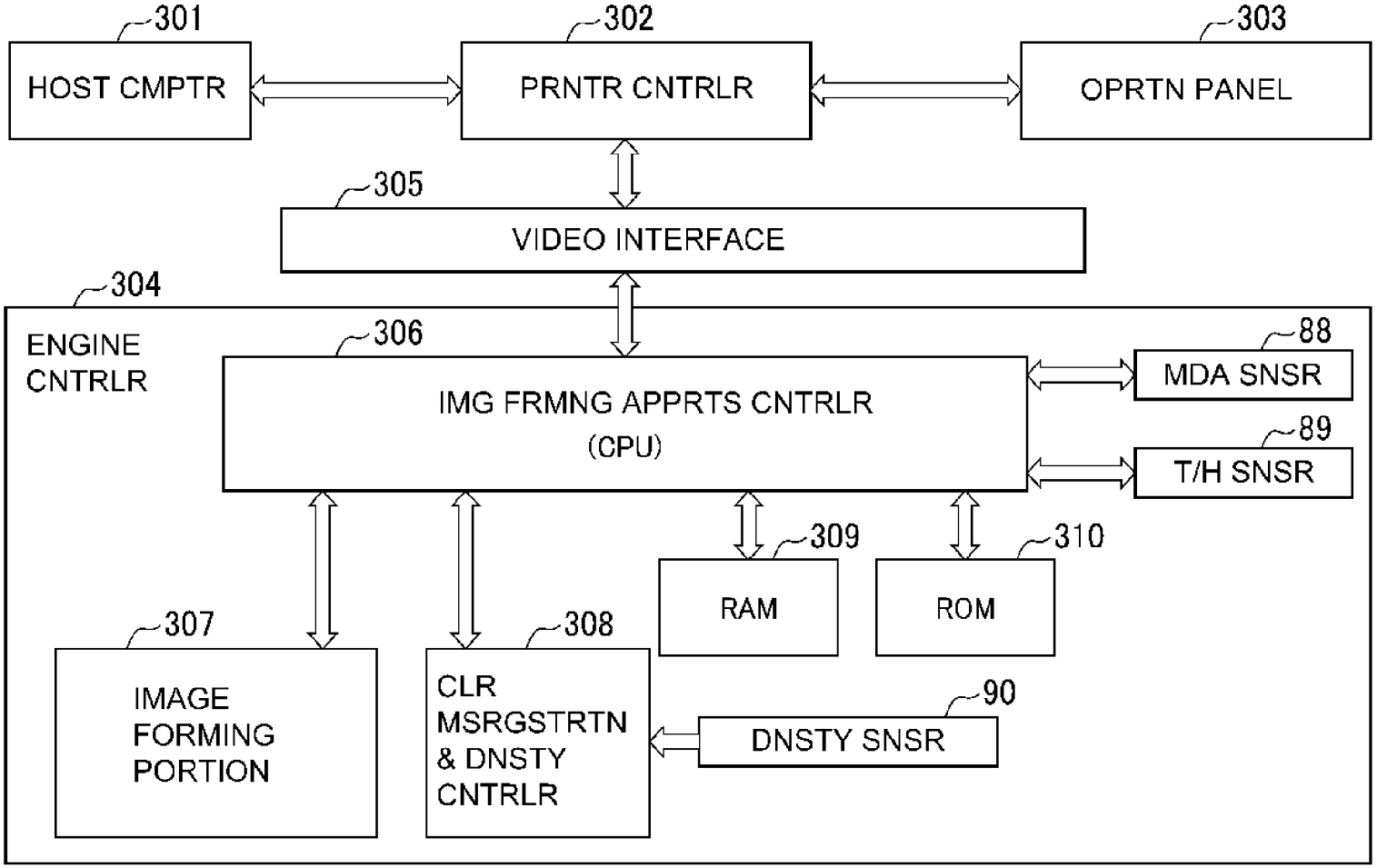
FIG. 2 is a functional block diagram for illustrating a system constitution of the image forming apparatus.

An image signal is sent from a host computer, connected directly or via a network to the image forming apparatus 100, to an image forming portion 307 as an image forming means via a printer controller 302 (FIG. 2). Alternatively, the image signal is sent from an operation panel 303 (FIG. 2) to the image forming portion 307 as the image forming means via the printer controller 302 (FIG. 2).

The image forming portion 307 includes a plurality of stations SY, SM, SC and SK for forming colors of yellow (Y), magenta (M), cyan (C) and black (K), respectively. In this embodiment, the stations SY, SM, SC and SK have the substantially same structure and operation except that the colors of developers used therein are different from each other. Therefore, in the case where there is no need to particularly differentiate constituent elements, suffixes Y, M, C and K for representing the elements for associated stations will be omitted and described collectively.

The station S includes a drum-type electrophotographic photosensitive member as an image bearing member capable of bearing a toner image, i.e., a photosensitive drum 50. The photosensitive drum 50 is rotatable in an arrow direction (clockwise direction) in FIG. 1 by a driving motor as a driving means. Around the photosensitive drum 50, in the order along a rotational direction of the photosensitive drum 50, the following means are provided. That is, a charging roller 52 as a charging member of a roller type, an exposure device (laser scanner) 51 as an exposure means, a developing device 53 as a developing means, a primary transfer roller 54 as a roller-type primary transfer member rotatably as a primary transfer member, and a drum cleaning device 55 as a photosensitive member cleaning means are provided. The charging roller 52 rotates in contact with a surface of the photosensitive drum 50. In the developing devices 53Y, 53M, 53C and 53K, a yellow toner, a magenta toner, a cyan toner and a black toner are accommodated, respectively.

Further, an endless intermediary transfer belt 40 as an intermediary transfer member is provided so as to oppose the photosensitive drums 50 of the respective stations S. As described above, the photosensitive drum 50 functions as the image bearing member but the intermediary transfer belt 40 also functions as the image bearing member capable of bearing (carrying) the toner image. Further, the intermediary transfer belt 40 is stretched by a plurality of rollers, as a supporting member, consisting of a driving roller 41, a tension roller 42 and a follower roller 43. The intermediary transfer belt 40 is rotatable in an arrow direction (counterclockwise direction) in FIG. 1 by driving the driving roller 41 by a driving motor as a driving means. The primary transfer roller 54 is provided at a position where it opposes the photosensitive drum 50 of its associated station S in an inner peripheral surface side of the intermediary transfer belt 40. The primary transfer roller 54 is urged against the intermediary transfer belt 40 toward the associated photosensitive drum 50 to form a primary transfer portion (primary transfer nip) N1 where the photosensitive drum 50 and the intermediary transfer belt 40 contact each other. Further, in an outer peripheral surface of the intermediary transfer belt 40, a secondary transfer roller 60 as a roller-type secondary transfer member (rotatable transfer member) rotatable as a secondary transfer means is provided at a position where it opposes the driving roller 41. The secondary transfer roller 50 is urged against the intermediary transfer belt 40 toward the driving roller 41 to form a secondary transfer portion (secondary transfer nip) N2 where the secondary transfer roller 60 and the intermediary transfer belt 40 contact each other.

During an image forming operation of an output image to be transferred onto a recording material P and then to be outputted, a DC voltage as a charging bias is applied to the charging roller 52, so that the surface of the photosensitive drum 50 is uniformly charged. Then, the charged surface of the photosensitive drum 50 is subjected to scanning exposure with laser light, by the exposure device 51, modulated on the basis of the image signal. As a result, on the photosensitive drum 50, an electrostatic latent image (electrostatic image) is formed. The electrostatic latent image is developed with a toner as a developer by the developing device 53. At this time, a DC voltage as a developing bias is applied to a developing roller as a developer carrying member provided in the developing device 53. As a result, the toner image is formed on the surface of the photosensitive drum 50. In this embodiment, the toner image is formed by image exposure and reverse development. That is, at an image portion of the develop 50 lowered in absolute value of a potential by charging the photosensitive drum 50 uniformly and then by exposing the photosensitive drum 50 to the laser light by the exposure device 51, the toner charged to the same polarity as a charge polarity (negative in this embodiment) of the photosensitive drum 50 is deposited.

For example, during full-color image formation, the respective color toner images formed on the photosensitive drums 50Y, 50M, 50C and 50K are successively transferred superposedly on the intermediary transfer belt 40 at the respective primary transfer portions N1. At this time, to each of the primary transfer rollers 54Y, 54M, 54C and 54K, a DC voltage as a primary transfer bias is applied. In this embodiment, a normal charge polarity of the toner is negative, and as the primary transfer bias, a positive DC voltage is used.

The toner remaining on the photosensitive drum 50 during the primary transfer is removed by the drum cleaning device 55.

The recording material P is fed by a sheet feeding roller 31 and is conveyed by a feed/retard roller pair 32 and a conveying roller pair 33, and then is further conveyed until it abuts against a registration roller pair 34. The recording material P is, after its oblique movement is corrected by the registration roller pair 34, conveyed to the secondary transfer portion N2 with predetermined timing. Then, at the secondary transfer portion N2, the toner images on the intermediary transfer belt 40 are secondary-transferred onto the recording material P. At this time, to the secondary transfer roller 60, a DC voltage as a secondary transfer bias is applied. In this embodiment, as the secondary transfer bias, a positive DC voltage is used. Further, in this embodiment, the secondary transfer roller 60 is rotated by the rotation of the intermediary transfer belt 40. Thus, the secondary transfer roller 60 is a rotatable transfer member for transferring the toner from the intermediary transfer belt 40 onto the recording material P while carrying and conveying the recording material P between itself and the intermediary transfer belt 40 at the secondary transfer portion N2.

During the secondary transfer of the toner images onto the recording material P, to the secondary transfer roller 60, the positive DC voltage providing a predetermined current depending on an operational environment and each print mode of the image forming apparatus 100 is selectively applied. Further, during a sheet interval of a continuous print job and after the job is ended, a negative DC voltage is applied to the secondary transfer roller 60. As a result, in the case where the intermediary transfer belt 40 is directly contacted to the secondary transfer roller 60 without via the recording material P, the toner on the intermediary transfer belt 40 is prevented from being transferred onto the secondary transfer roller 60 by electrically pushing the toner back to the intermediary transfer belt 40 to relieve the transfer of the toner.

The toner remaining on the intermediary transfer belt 40 during the secondary transfer is removed by the belt cleaning device 44 as an intermediary transfer member cleaning means.

The recording material P on which the toner images are transferred is conveyed to a fixing device 61 as a fixing means by the secondary transfer roller 60 and the intermediary transfer belt 40. In the fixing device 61, the recording material P is nip-fed by a fixing roller 62 and a pressing roller 63, so that the toner images are fixed on the recording material P. The recording material P passing through the fixing device 61 is conveyed by a fixing device discharging roller pair 64 and a sheet discharging roller pair 65 and is discharged and stacked as a sheet discharge tray 66.

Here, in the case where a both-side print command is sent from the printer controller 302 (FIG. 2) to the image forming portion 307, the recording material P on which the image is formed on its first side is conveyed again to the secondary transfer portion N2 by a conveying means for both-side printing. That is, the recording material P is reversed in direction by the sheet discharging roller pair 65 and is conveyed, via a conveying path 70 for both-side printing provided in a right end portion side in FIG. 1, until the recording material P abuts again against the registration roller pair 34 in a drive-stop state. In this embodiment, the conveying means is controlled by the sheet discharging roller pair 65, the conveying path 70 and the like. In the both-side printing by the image forming apparatus, in order to ensure a throughput of the both-side printing, the recording material subjected to the image formation on the first side thereof is placed in a stand-by state in the conveying path 70 in general. In the image forming apparatus 100, in the case where the both-side printing is effected by feeding an A4-sized recording material P by long edge feeding (by conveying the recording material P along a widthwise direction of the recording material P), it is possible to place two sheets of the recording material P in the conveying path 70. That is, the first side-image formation of the two sheets of the recording material P in successively effected and then second side image formation of the two sheets of the recording material P is successively effected. Thus, when such a constitution in which the two sheets of the recording material P is placed in the stand-by state in the conveying path 70 is employed, the sheet interval can be made equal to that in the case of one-side printing, with the result that it is possible to achieve the same throughput as that of the one-side printing.

Further, in the image forming apparatus 100, various sensors are provided for enabling stable printing even under various operational environments. Representative examples thereof may include a media sensor 88, a temperature/humidity sensor 89 and a density/color misregistration sensor (hereinafter simply referred to as a density sensor) 90.

The media sensor 88 may detect a type and/or surface property of the recording material P. In this embodiment, the media sensor 88 is provided upstream of the registration roller pair 34 with respect to a conveyance direction of the recording material P and detects brightness information and surface roughness information of the recording material P which is once in rest at the registration roller pair 34. Then, the media sensor 88 obtains smoothness of the recording material P and sends its result to an image forming apparatus controller (hereinafter referred to as CPU) 306 (FIG. 2). As a result, the CPU 306 discriminates the type of the recording material P and then selects an optimum print mode.

The temperature/humidity sensor 89 may detect a temperature and/or humidity at an inner and/or outer portion of the image forming apparatus 100. In this embodiment, the temperature/humidity sensor 89 is provided immediately inside an outer casing of the image forming apparatus 100 in a left side (in FIG. 1) as seen from a front side of an apparatus main assembly of the image forming apparatus 100, and detects an inside temperature/humidity of and an ambient temperature/humidity of the image forming apparatus 100. In general, in the image forming apparatus of the electrophotographic type, an image-formed product is changed in quality depending on the temperature and the humidity and therefore on the basis of these pieces of image, an image forming condition (process condition) such as the charging bias of the transfer bias is appropriately changed to an optimum value. Further, the density sensor 90 is an optical sensor for measuring color misregistration among the colors and an image density. The density sensor 90 is provided at two positions along a conveyance direction (movement direction of the intermediary transfer belt 40 and a direction (thrust direction) perpendicular to the conveyance direction. The image forming apparatus 100 in this embodiment performs, in addition to a normal print operation for forming and outputting the image on the recording material P, a density adjusting operation for adjusting the image density. For example, the density adjusting operation is performed with predetermined timing such as timing of exchange of parts of the image forming portion 307 or timing of every printing (every 1000 sheets in this embodiment). In the density adjusting, patches as test images of a plurality of gradation levels formed on the intermediary transfer belt 40 are read by the density sensor 90 to adjust a density gradation characteristic, so that desired density output depending on the input signal is enabled.

In this embodiment, the CPU 306 constitutes a control means for controlling an operation for forming the test images with the toners in an (image) interval region (sheet interval region) between consecutive output images on the intermediary transfer belt.

2. Functional Block of Image Forming Apparatus

FIG. 2 is a functional block diagram for illustrating a system constitution of the image forming apparatus 100. The printer controller 302 is capable of mutually communicating with a host computer 201 or an operating panel 303 and is also capable of mutually communicating with an engine controller 304. The printer controller 302 receives normal print image information and a print command (instruction) from the host computer 301 or the operating panel 303. Then, the printer controller 302 analyzes the received image information and converts the image information into bit data, and then sends a reversed print command, a print start command and a video signal to the engine controller 304 every recording material P via a vide interface portion 305. Then, the printer controller 302 sends the reserved print command to the engine controller 304 in accordance with the print command from the host computer 301 and then sends the print start command to the engine controller 304 with timing when the image forming apparatus 100 is in a printable state. The engine controller 304 starts a printing operation after receiving the print start command from the printer controller 302.

Specifically, the CPU 306 controls, on the basis of the information received from the printer controller 302 via the video interface portion 305, the image forming portion 307 to complete a designated printing operation. The CPU 306 also performs the functions of controlling the above-described sensors and operations using the sensors. For example, the CPU 306 controls a control misregistration/density controller 308 for controlling the density sensor 90 to also functions as a means for forming sheet interval patches for being detected by the density sensor 90. The CPU 306 makes reference to RAM 309 or ROM 310 and renews its information during the printing operation or the density adjusting operation. In the RAM 309, e.g., a detection result of the density sensor 90 is stored. In the ROM 310, set values of the image forming portion 307 for each of print modes are stored.

3. Density Sensor as Sheet Interval Patch Density Detecting Means

Figure 3:
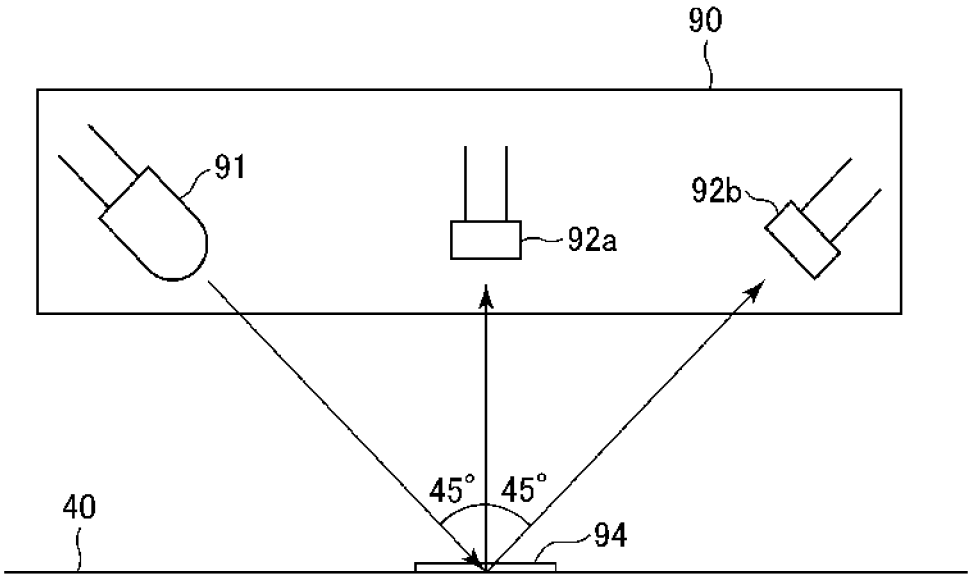
FIG. 3 is a schematic illustration of a density sensor provided in the image forming apparatus.

A constitution of the density sensor 90 as a detecting means for detecting the density of the sheet interval patch in the sheet interval density adjusting operation during a continuous print job in this embodiment will be described. FIG. 3 is a schematic view for illustrating the constitution of the density sensor 90.

As shown in FIG. 3, the density sensor 90 is disposed at a position where it faces the intermediary transfer belt 40 and a sheet interval patch 94. The density sensor includes a light emitting element 91 and first and second light receiving elements 92*a* and 92*b*. In this embodiment, as the light emitting element 91, an LED for infrared light emission ("SIR-34ST3F", mfd. by ROHM, Co., Ltd.) was used. Further, as the first and second light receiving elements 92*a* and 92*b*, a phototransistor having light receiving sensitivity to the infrared light ("RPT-37PB3F", mfd. by ROHM, Co., Ltd.) was used. The surface of the intermediary transfer belt 40 is irradiated with the infrared light emitted from the light emitting element 91 at an angle of 45 degrees from the vertical direction of the intermediary transfer belt 40. The first and second light receiving elements 92*a* and 92*b* are disposed at positions of angles of 0 degrees and −45 degrees from the vertical direction of the intermediary transfer belt 40 with respect to the irradiation angle. The first and second light emitting elements 92*a* and 92*b* receive diffused reflection light and specular reflection light, respectively, from the surface of the intermediary transfer belt 40 or the sheet interval patch 94 on the intermediary transfer belt 40. Thus, by detecting both of diffused reflection light intensity and specular reflection light intensity, it is possible to detect a patch density in a range from a high density to a low density.

4. Arrangement of Sheet Interval Patches

Figure 4:
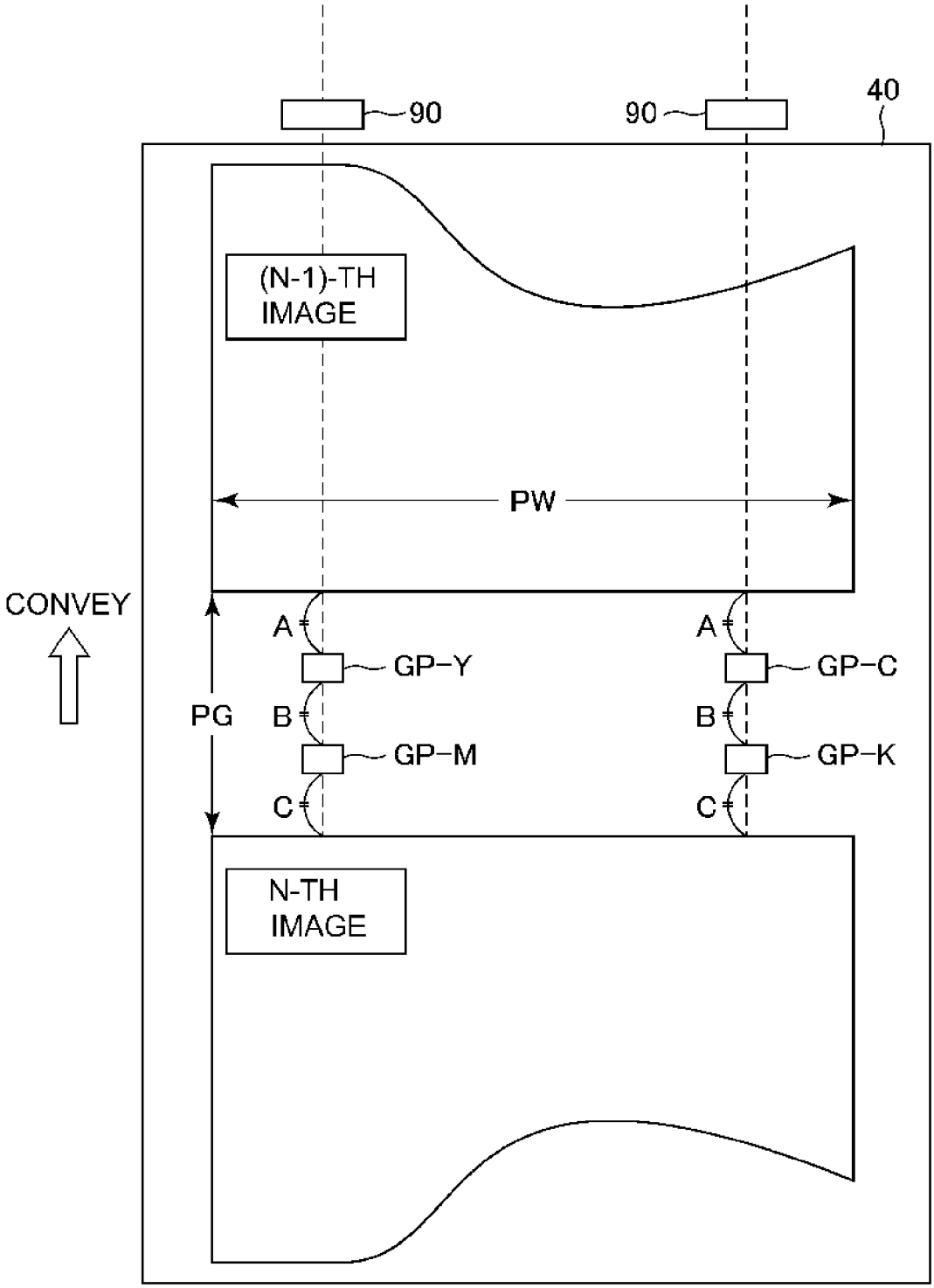
FIG. 4 is a schematic illustration showing arrangement of sheet interval patches used for sheet interval density adjusting in the image forming apparatus.

FIG. 4 is a schematic view for illustrating arrangement of the sheet interval patches used in the sheet interval density adjusting operation in this embodiment. In FIG. 4, a sheet interval patch formation state on the intermediary transfer belt 40 in the case where the image forming apparatus is viewed from above is schematically shown.

As shown in FIG. 4, in a sheet interval region (interval region) PG between an (N−1)-th image and an N-th image formed on the intermediary transfer belt 40 during the continuous print job, four (one for each color) sheet interval patches are formed. As shown in the figure, in this embodiment, as the sheet interval patches, two sets each consisting of two sheet interval patches are formed in two regions with respect to the direction (thrust direction) perpendicular to the conveyance direction of the intermediary transfer belt 40. More specifically, in one end side with respect to the thrust direction, a yellow patch (GP-Y) and a magenta patch (GP-M) are arranged along the conveyance direction of the intermediary transfer belt 40, and in another end side with respect to the thrust direction, a cyan patch (PG-C) and a black patch (PG-K) are arranged along the conveyance direction of the intermediary transfer belt 40.

Each color patch is disposed so that its detection spot of the density sensor 90 overlaps with a central portion thereof. In the conveyance direction of the intermediary transfer belt 40, the respective color patches are arranged in the sheet interval region (interval region), with a length PG, which is a region between an image and a subsequent image in the following manner. That is the color patches are disposed so that a spacing (interval) A between the trailing end of the (N−1)-th image and a front-side patch (GP-Y, GP-C), a spacing B between the front-side patch (GP-Y, GP-C) and a rear-side patch (GP-M, GP-K) and a spacing C between the rear-side patch (GP-M, GP-K) and a trailing end of the N-th image are equal to one another. Further, with respect to the thrust direction, each of the four sheet interval patches is disposed inside a region with a width PW of a usable maximum-sized recording material P in the image forming apparatus 100. This is because the density sensor 90 also functions as a sensor for correcting the color misregistration and therefore there is a constraint on the arrangement in order to ensure a color misregistration correction performance also with respect to the width PW of the usable maximum-sized recording material P.

5. Detection of Sheet Interval Patch

Figure 5:
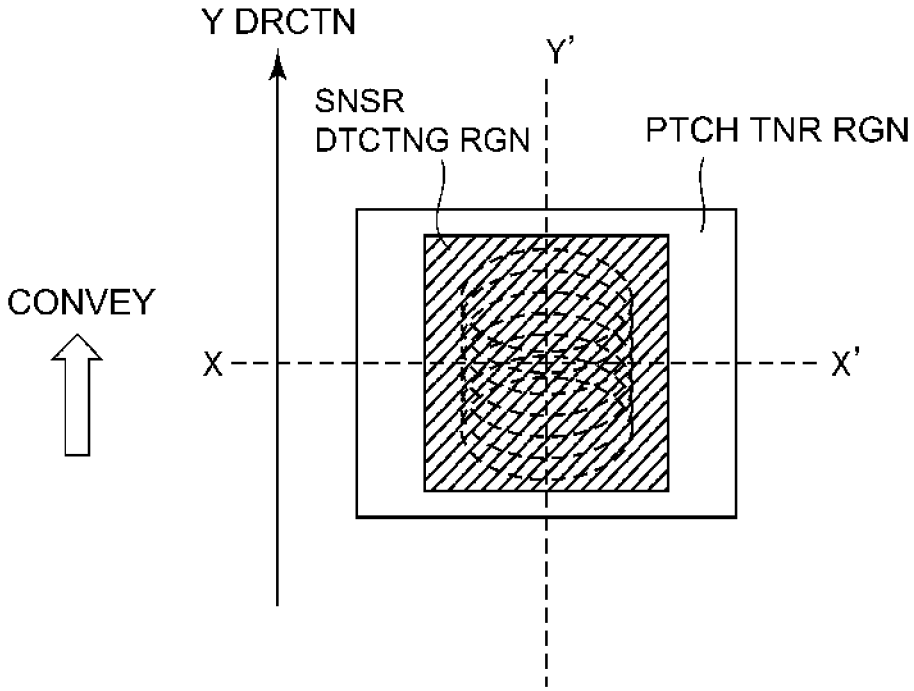
FIG. 5 is a schematic illustration of the sheet interval patch on an intermediary transfer belt in the image forming apparatus.

FIG. 5 is a schematic view showing a sheet interval patch on the intermediary transfer belt 40 in this embodiment. In FIG. 5, a Y direction coincides with the conveyance direction of the intermediary transfer belt 40. A hatched-line portion represents a region to be density-detected necessary to accurately detect the density of the sheet interval patch by the density sensor 90. In this embodiment, the region to be density-detected has a size of 10 mm (conveyance direction dimension)×10 mm (thrust direction dimension) of the intermediary transfer belt 40. Further, a patch toner region where the toner of the sheet interval patch is actually placed on the intermediary transfer belt 40 is set so as to be sufficiently larger than the region to be density-detected in view of factors, such as mounting accuracy of the density sensor 90, lateral shift of the intermediary transfer belt 40 in the thrust direction and deviation of an image formation position with respect to the conveyance direction of the intermediary transfer belt 40. In this embodiment, the patch toner region is set at 12 mm (conveyance direction dimension)×15 mm (thrust direction dimension) of the intermediary transfer belt 40. The density sensor 90 detects the patch density plural times in the region to be density-detected as the hatched-line portion to obtain detection outputs and then averages the detection outputs. As a result, density non-uniformity in the patch and a random noise of the density sensor 90 itself are canceled, so that detection accuracy can be improved. The CPU 306 calculates a patch density from a ratio between a net specular reflection light quantity from the intermediary transfer belt 40 and a net specular reflection light quantity from the patch, which are obtained in the above-described manner.

6. Contamination of Recording Material (Print) Product

In this embodiment, the length PG of the sheet interval region is 55 mm. On the other hand, in this embodiment, a peripheral (circumferential) length of the secondary transfer roller 60 is 75.4 mm. That is, in this embodiment, the sheet interval region length PG is shorter than the peripheral length of the secondary transfer roller 60. For that reason, the toner deposited from the sheet interval patch onto the secondary transfer roller 60 can be transferred back onto its back surface of the recording material P onto its front side a subsequent image is to be transferred, thus resulting in contamination of the recording material (print product) (herein also referred to as back contamination) in some cases.

In the image forming apparatus 100 in this embodiment, when the sheet interval region passes through the secondary transfer portion N2, the native DC voltage (having the same polarity as the normal charge polarity of the toner) of −50 V is applied to the secondary transfer roller 60. As a result, in the case where the intermediary transfer belt 40 directly contacts the secondary transfer roller 60 without via the recording material P, a degree of the transfer of the toner from the intermediary transfer belt 40 onto the secondary transfer roller 60 can be alleviated by electrically pushing the toner back to the intermediary transfer belt 40. However, as described above, the formation of the AC electric field at the secondary transfer portion and the separation and contact of the secondary transfer roller are disadvantageous from the viewpoint of productivity and therefore in this embodiment, such constitutions are not employed. For that reason, in this embodiment, the toner physically transferred onto the secondary transfer roller 60 cannot be completely removed.

Therefore, in this embodiment, the sheet interval patch is, as described later, formed only under a condition such that the back contamination is inconspicuous. Further, in this embodiment, a method in which a cleaning step for removing the toner, deposited on the secondary transfer roller 60 by transferring back the toner to the intermediary transfer belt 40, during post-rotation which is a processing operation (preparatory operation) after the end of the print job is employed.

Specifically, in the cleaning step during the post-rotation, negative and positive DC voltages are alternately applied to the secondary transfer roller 60 every one-full-turn while decreasing an absolute value of each thereof through three full turns, i.e., through six full turns in total. For example, in a normal temperature and normal humidity condition, the DC voltages of −3200 V, +1200 V, −2100 V, +800 V<−330 V and +300 V are applied in this order. As a result, even in the case where a polarity-inverted toner is present, irrespective of the toner charge property, the toner can be transferred back from the secondary transfer roller 60 onto the intermediary transfer belt 40. Incidentally, the toner transferred back to the intermediary transfer belt 40 is removed by a belt cleaning device 44.

7. Sheet Interval Density Adjustment 7-1. Summary

The sheet interval density adjusting operation in this embodiment will be described. In this embodiment, during a continuous printing job of a plurality of pages (sheets), the density of the sheet interval patch formed in the sheet interval region is detected by the density sensor 90 and the CPU 306 as a sheet interval density adjusting means performs a density adjusting operation on the basis of a result of the detection.

Specifically, the patch operation will be described with reference to a flow chart of FIG. 7. Immediately after the print job is started in accordance with a signal from the printer controller 302, the CPU 306 discriminates whether or not a remaining print number of the print job is 4 sheets or more in step 1. Here, the remaining print number refers to the number of images to be formed on the intermediary transfer belt 40. This is because in the image forming apparatus 100 in this embodiment, from a constraint on a part arrangement constitution, the remaining print number is set so that the sheet interval density adjusting operation is performed only when it is not less than a certain number of sheets. Specifically, in this embodiment, in the case of a print job in which sheets of A4-sized recording material P are fed in a long edge feeding manner, in a continuous print job of 4 or more sheets, the sheet interval density adjusting operation is executed. That is, at the time when the density of the sheet interval patch formed in the sheet interval between a first image and a second image which are formed on the intermediary transfer belt 40 in the continuous print job is detected by the density sensor 90, a third image has already been started to be formed on the upstream-most photosensitive drum 54Y for yellow. For that reason, density adjusting information can only be reflected with respect to a fourth or later image is formed. However, in this embodiment, in such a case, with respect to the second and third images, the color misregistration/density controller 308 estimates a density fluctuation on the basis of a detection result of the temperature/humidity sensor 89 and life time recording information of each photosensitive drum 50 stored in RAM 309. As a result, the image forming apparatus 100 is stabilized. Incidentally, numerical values of these four sheets are values depending on a constitution of the image forming apparatus 100, such as a distance from the primary transfer portion N1Y of the upstreammost station SY for yellow to a detecting portion by the density sensor 90 or a switching time of each high-voltage, or on a size of the recording material P for printing. Therefore, the present invention is not limited to these numerical values.

The CPU 306 executes, in the case where the remaining print number is 4 sheets in the step 1, sheet interval patch formation go/no-go discrimination processing, described later, in step 3. Thereafter, the CPU 306 performs, in the case where a sheet interval patch formation flag is "1" in step 4, process operations of step 5 for forming the sheet interval patch and later steps. The process operations of the step 5 and later steps will be described later.

7-2. Sheet Interval Patch Formation Timing

A sheet interval patch forming condition for improving the productivity and density stability while suppressing the occurrence of the back contamination of the recording material P with the sheet interval patch will be described.

In the image forming apparatus 100 in this embodiment, importance is placed on a real time property of adjustment and on the basis of a detection result of the density of the patch for each color with a single gradation level, the adjustment of the image forming condition is effected. In this embodiment, basically, the sheet interval patch is formed in all the sheet intervals and its density is detected and thereafter the image forming condition is adjusted.

The back contamination of the recording material P with the sheet interval patch is liable to appear under a condition in which the toner on the secondary transfer roller 60 is deposited on the image formed on the first (front) side of the recording material P during both-side printing. That is, the back contamination is liable to appear at the time when the patch is formed in the sheet interval immediately before the image for being transferred onto the second (back) side of the recording material P is formed. The reason why the back contamination of the recording material P is liable to appear under the condition can be considered as follows. First, an amount of the toner deposited on the toner for the image formed on the first side is increased, for the reasons (1) and (2) below, compared with the case where powdery toner is deposited on the recording material P such as paper only by an electrostatic force.

(1) Intermolecular force of toner particles, and (2) A wax with a high affinity for the toner is present on the image formed on the first side of the recording material P passing through the fixing device, so that the toner is liable to be deposited on the first side of the recording material P.

Further, depending on the color of the toner (image) formed on the first side of the recording material, a difference in brightness is liable to be visually recognized by human eyes. That is, under a condition such that a yellow solid image is formed on the first side of the recording material P and then a black sheet interval patch is formed in a sheet interval immediately before the image is formed on the second side of the recording material P, the back contamination of the recording material P is most liable to appear from the viewpoints of a deposition amount of the toner and ease of the visual recognition. In this embodiment, study was made under the condition, which is a most severe condition for suppression of the back contamination, such that the yellow solid image is formed on the first side of the recording material P and then the black sheet interval patch is formed in the sheet interval immediately before the image is formed on the second side of the recording material P. When an effect of suppressing the back contamination is obtained under the condition, a similar effect or more is obtained also under a condition in which the back contamination is less conspicuous.

As a simplest method for discriminating go/no-go of the sheet interval patch formation, the following method can be used. That is, in the case where an output image which reaches the secondary transfer portion N2 during a period from passing of a position of the sheet interval patch in a certain sheet interval through the secondary transfer portion N2 until the secondary transfer roller 60 is rotated through a predetermined number of turns (more than zero) is to be transferred onto the first side of the recording material P, formation of the sheet interval patch in the certain sheet interval is permitted. In other words, formation of a test image in the interval region, when a subsequent output image passing through the secondary transfer portion N2 is to be transferred onto the first side of the recording material P, is permitted. On the other hand, in the case where an output image which reaches the secondary transfer portion N2 during a period from passing of a position of the sheet interval patch in a certain sheet interval through the secondary transfer portion N2 until the secondary transfer roller 60 is rotated through a predetermined number of turns (more than zero) is to be transferred onto the second side of the recording material P, formation of the sheet interval patch in the certain sheet interval is prevented. In other words, formation of a test image in the interval region, when a subsequent output image passing through the secondary transfer portion N2 is to be transferred onto the second side of the recording material P, is prevented. In this embodiment, the above-described predetermined number is one full turn of the secondary transfer roller 60 by which a degree of the back contamination of the recording material P with the toner deposited from the sheet interval patch on the secondary transfer roller 60 is most conspicuous. However, through plural turns of the secondary transfer roller 60, the back contamination of the recording material P with the toner deposited from the sheet interval patch to the secondary transfer roller 60 can occur to a degree exceeding a tolerable degree. Therefore, the predetermined number can be appropriately set so that the back contamination of the recording material P can be sufficiently suppressed. Further, as described above, in this embodiment, when the sheet interval length is shorter than the peripheral length of the secondary transfer roller 60 and the sheet interval patch P in the certain sheet interval overlaps with the recording material P which reaches the secondary transfer portion N2 during the period from the passing of the recording material P through the secondary transfer portion N2 until the secondary transfer roller 60 is rotated through one full turn, an image immediately after the certain sheet interval is to be formed on the recording material P. Thus, as the simplest method of discriminating the go/no-go of the sheet interval patch formation, in this embodiment, in the case where the image immediately after the certain sheet interval is to be transferred onto the second side of the recording material P, the formation of the sheet interval patch in the sheet interval can be prevented.

In the image forming apparatus 100 in this embodiment, discrimination as to whether the image is to be formed on the first side of the recording material P or the second side of the recording material P can be made by the CPU 306 depending on whether or not the recording material P is conveyed from the conveying path 70. Then, in the sheet interval immediately before the image formation on the second side, the image region is masked to prevent the formation of the sheet interval patch. According to this method, irrespective of whether or not what image is formed on the first side, the sheet interval patch formation can be always prevented in the sheet interval immediately before the image is to be formed on the second side of the recording material P. For that reason, there is no need to store information of the image formed on the first side of the recording material P, so that simple control can be effected.

Figure 7:
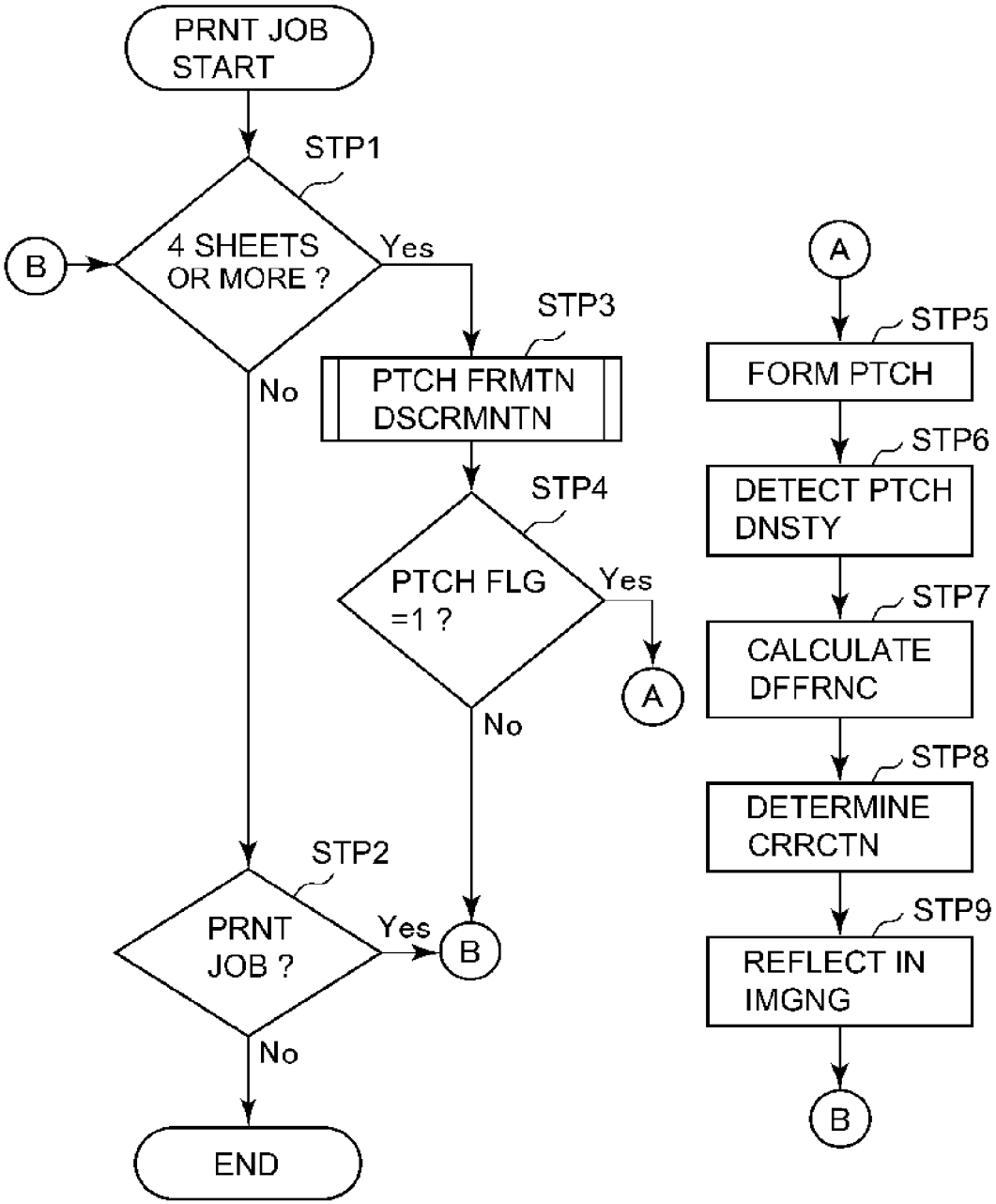
FIG. 7 is a flow chart of the sheet interval density adjusting.
Figure 8:
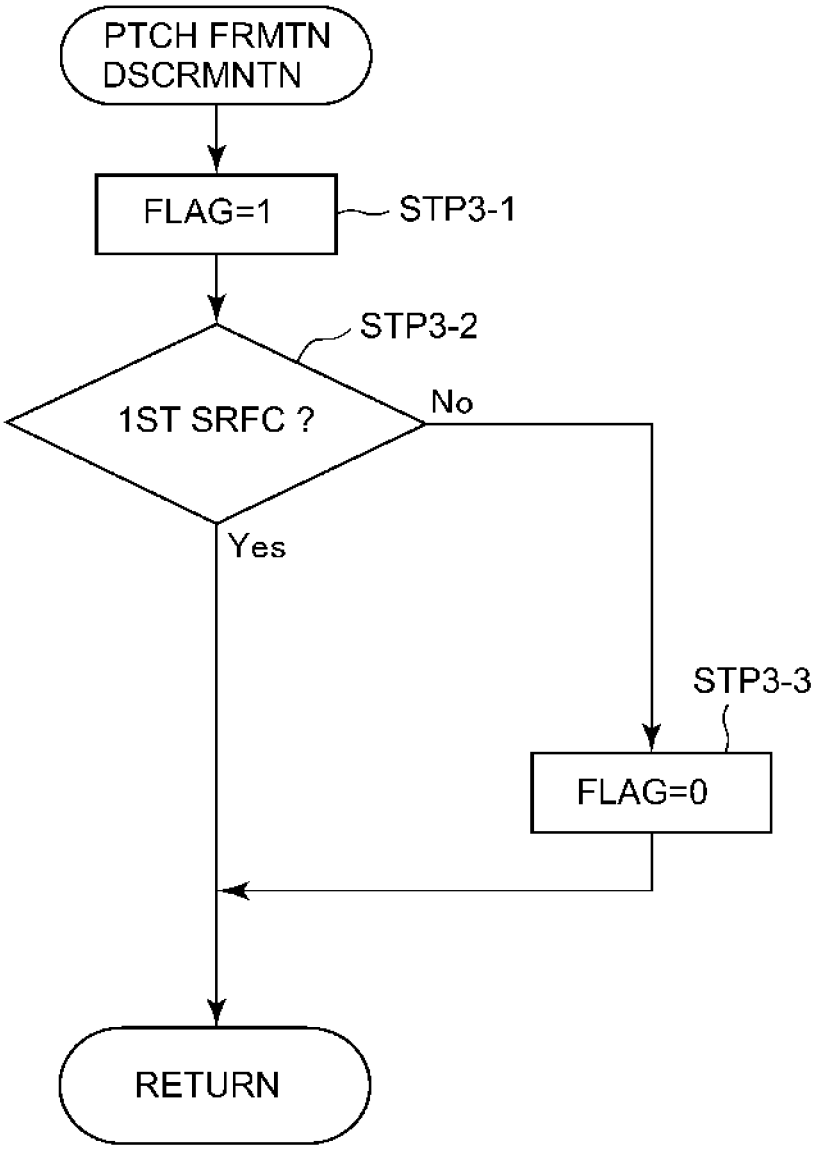
FIG. 8 is a flow chart of an example of sheet interval patch formation go/no-go discrimination process.

FIG. 8 is a flow chart of an example of the sheet interval patch formation go/no-go discrimination processing which is a subroutine executed in the step 3 in the flow chart of FIG. 7. In this embodiment, in the case where the image immediately after the sheet interval is to be transferred onto the second side of the recording material P, the sheet interval patch formation in the sheet interval is always prevented as described above.

First, in step 3-1, the CPU 306 sets a sheet interval patch formation flag at "1" in the RAM 309. Then, in step 3-2, the CPU 306 discriminates whether the image to be formed immediately after the sheet interval patch formation is to be formed on the first side of the recording material P or the second side of the recording material P. This discrimination corresponds to discrimination as to whether or not a subsequent output image passing through the transfer portion in the interval region which is a candidate for the sheet interval patch formation is the image formed on the first side of the recording material P. Further, in this embodiment, this discrimination is made by whether or not the recording material P onto which the associated image is to be transferred is conveyed by being passed through the conveying path 70. In the step 3-2, in the case where the image to be formed immediately after the formation of the sheet interval patch is the image to be formed on the first side of the recording material P, the CPU 306 terminates the subroutine in order to form the sheet interval patch and the sequence goes to step 4 in the flow chart of FIG. 7. On the other hand, in the case where the image to be formed immediately after the formation of the sheet interval patch is the image to be formed on the second side of the recording material P, the CPU 306 sets the sheet interval patch formation flag at "0" in the RAM 309. Thereafter, the subroutine is ended and the sequence goes to the step 4 of the flow chart of FIG. 7. As a result, the formation of the sheet interval patch in the sheet interval immediately before the image is to be formed on the second side of the recording material P is prevented P.

On the other hand, e.g., under a condition in which a color fluctuation during the continuous image forming job is abrupt or under a condition in which the number of necessary gradational levels is large, a frequency of the sheet interval patch formation may desirably be made high. Thus, in some cases, the sheet interval patch is intended to be formed, also in the sheet interval immediately before the image formation on the second side of the recording material P, to the possible extent.

In this case, the following method may preferably be used. That is, the sheet interval patch formation in the sheet interval is prevented in the case where the output image which reaches the secondary transfer portion N2 during rotation of the secondary transfer roller 60 through a predetermined number of turns after the passing of the sheet interval patch is to be outputted on the second side of the recording material P and further in the case where the output image transferred on the first side of the recording material P satisfies a predetermined condition. In other words, even in the case where the output image which reaches the secondary transfer portion N2 during the rotation of the secondary transfer roller 60 through the predetermined number of turns after the passing of the sheet interval patch, when the output image transferred on the first side of the recording material P satisfies the predetermined condition, the sheet interval patch formation in the sheet interval is permitted. In this case, with respect to the entire output image transferred on the first side of the recording material P, whether or not the predetermined condition is satisfied may also be discriminated. However, in order to estimate a possibility of the occurrence of the back contamination of the recording material P with high accuracy and to enhance the frequency of the sheet interval patch formation to the possible extent, the following method may preferably be used. That is, in the case where the image, of the image formed on the first side of the recording material P on its second side an image is to be formed, in a region where the back contamination is liable to appear (hereinafter simply referred to as a predetermined position) satisfies the predetermined condition, the sheet interval patch formation in the sheet interval immediately before the image to be formed on the second side of the recording material P is prevented. The predetermined position (potential back contamination region) where the back contamination is liable to appear is a position where a portion of the image formed on the first side of the recording material on its second side an image is to be formed is contacted to the secondary transfer portion N2 at a position where the sheet interval patch is contacted to the secondary transfer portion N2. Thus, the go/no-go of the sheet interval patch formation may preferably be discriminated depending on whether or not the image (portion), of the output image transferred on the first side of the recording material P, located at the predetermined position where the secondary transfer roller 60 to which the sheet interval patch in the sheet interval is contacted is contacted satisfies the predetermined condition.

Whether or not the image formed on the first side of the recording material P on its second side an image is to be formed can be discriminated by the CPU 306 on the basis of image information of the image formed on the first side. Particularly, as described above, the back contamination is accelerated by the presence of the toner on the first side, so that as the predetermined condition, a value correlated with the toner amount per unit area of the image may preferably be set. For example, the sheet interval patch formation can be prevented in the case where the toner amount per unit area corresponding to an image density, a print ratio or an image pattern of the output image on the first side is a predetermined threshold or more. Further, as described above, the ease of visual recognition of the back contamination varies depending on the color (brightness) of the image on the first side and therefore as the predetermined condition, the color of the image can be set in place of or in addition to the toner amount per unit area. For example, in the case where the color of the output image on the first side is a designated color such as yellow, the sheet interval patch formation can be prevented. In this embodiment, particularly, on the basis of the image density of the image on the first side at the predetermined position, the go/no-go of the sheet interval patch formation is discriminated but as described above, the print ratio, the image pattern or the color of the image on the first side at the predetermined position may also be used as a discrimination criterion. Further, these conditions may preferably be discriminated, as described above, with respect to the predetermined position of the image on the first side but may also be discriminated on the basis of an average or the like with respect to the entire image on the first side.

An example of the sheet interval patch formation go/no-go discrimination processing capable of increasing the sheet interval patch formation frequency to the possible extent will be described. The go/no-go of the sheet interval patch formation is discriminated on the basis of the toner amount per unit area of the image on the first side at a position to which a position of the secondary transfer roller 60 corresponding to the sheet interval patch is contacted after the sheet interval patch passes through the secondary transfer portion N2 and then is rotated through one full turn.

Figure 9:
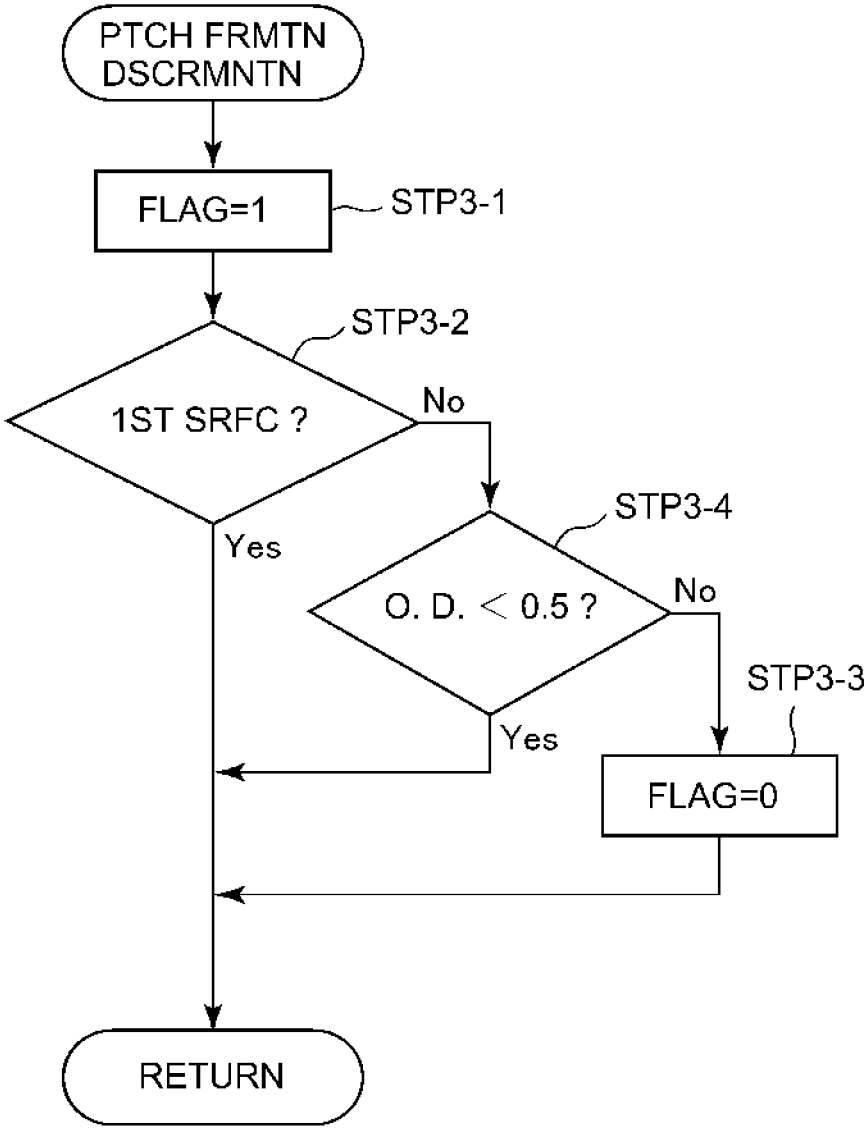
FIG. 9 is a flow chart of another example of the sheet interval patch formation go/no-go discrimination process.

FIG. 9 is a flow chart of an example of the sheet interval patch formation go/no-go discrimination processing which is another subroutine executed in the step 3 in the flow chart of FIG. 7. In this embodiment, as described above, the go/no-go of the sheet interval patch formation in each sheet interval is discriminated on the basis of the image information on the first side at the predetermined position where the back contamination of the recording material P is liable to occur. Only a difference from FIG. 9 will be described.

Processing shown in FIG. 9 is different from the processing shown in FIG. 8 in that step 3-4 in which whether or not the image density, at the predetermined position, of the image formed on the first side of the recording material on its second side an image is to be formed is a threshold or more is employed. That is, in this embodiment, in the step 3-2, in the case where the image to be formed immediately after the sheet interval patch is formed is the image to be formed on the second side, the following process is effected. That is, in the step 3-4, the CPU 306 discriminates the go/no-go of the formation of the sheet interval patch depending on the image density of the image on the first side of the recording material P at the predetermined position.

The CPU 306 obtains the image density at the predetermined position from bit data converted based on the image information received by the printer controller 302 and a density gradation characteristic after adjustment described later. The image density obtained from the image information correlates with the toner amount per unit area of the image actually formed on the recording material P.

Further, in this embodiment, in the step 3-4, in the case where the image density is 0.5 or more as a reflection density (O.D.), the CPU 306 sets the sheet interval patch formation flag at "0" in the RAM 309 in step 3-3. Thereafter, the subroutine is ended and the sequence goes to the step 4 of the flow chart of FIG. 7. As a result, the formation of the sheet interval patch in the sheet interval immediately before the image is to be formed on the second side of the recording material P is prevented P. Further, in the step 3-4, in the case where the image density is less than 0.5 as the reflection density (O.D.), the CPU 306 keeps the sheet interval patch formation flag in the RAM 309 at "1" in order to form the sheet interval patch and ends the subroutine, so that the sequence goes to the step 4 of the flow chart of FIG. 7. In the image forming apparatus in this embodiment, the image density corresponding to the reflection density of 0.5 was 50% as the print ratio (a ratio of a density level in the case where the density level of a solid image is 100%).

Here, the reflection density in each embodiment is a value of Dr represented by an equation below when a light quantity of light incident on a reflection surface is I0 and a light quantity of light reflected from the reflection surface is I.

$$Dr=\mathrm{Log}_{10}(I0/I)$$

In general, the reflection density can be obtained by emitting the light from a direction of an angle of 45 degrees from a normal to the reflection surface and then by measuring the light reflected in a direction perpendicular to the reflection surface. In each embodiment, specifically, the reflection density is a value measured by using a reflection density measuring device ("RD-918", mfd. by X-Rite Inc.). Particularly, in each embodiment, the reflection density of each of the patch and the image on the first side is a value measured by the reflection density measuring device after the transfer onto the paper but before the fixing. In the following description, description such that the CPU 306 discriminates the reflection density will be made but there is a certain relationship between the reflection density Dr and the reflected light quantity I and therefore, the reflected light quantity I may also be discriminated directly.

Next, a specific position of the predetermined position will be described.

Figure 6:
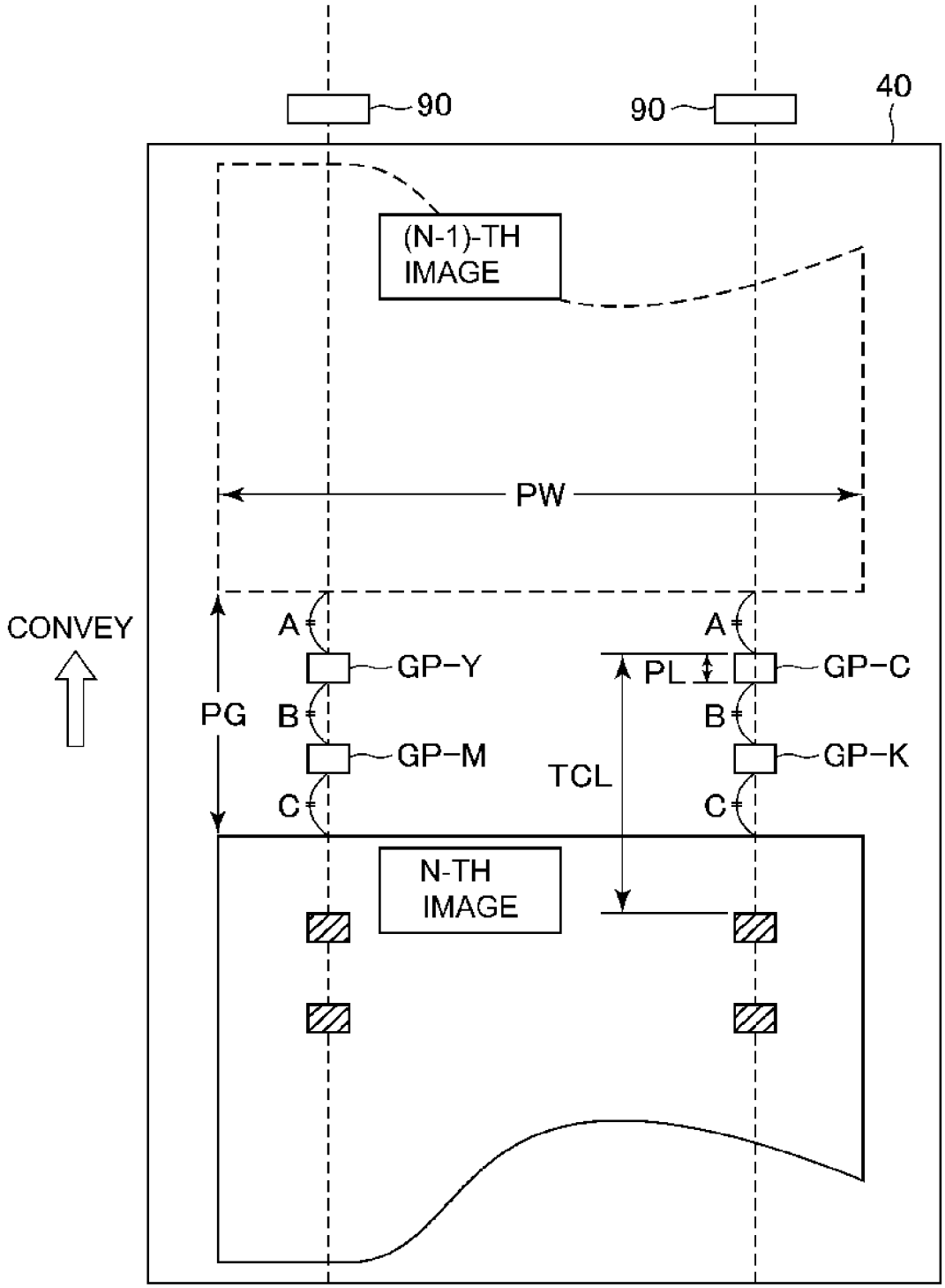
FIG. 6 is a schematic illustration showing the arrangement of the sheet interval patches and a position of an occurrence of contamination of a recording material (print).

As shown in FIG. 6, the peripheral (circumferential) length is TCL, and the distance from the trailing end of the (N−1)-th image to a front-side edge of the front-side patch (GP-Y, GP-C) is A. Further, the spacing between the front-side patch (GP-Y, GP-C) and the rear-side patch (GP-M, GP-K) is B, the length of each patch with respect to the conveyance direction is PL, and the length of the sheet interval (region) with respect to the conveyance direction is PG.

In this case, the contamination with the front-side patch (PG-Y, PG-C) is liable to occur from a position of "TCL+A−PG" to a position of "TCL+A−PG+PL) with respect to the leading end (edge) of the N-th image which is an image to be formed on the recording material P. Further, the contamination with the rear-side patch (PG-M, PG-K) is liable to occur from a position of "TCL+A−PG+PL+B" to a position of "TCL+A−PG+2PL+B" with respect to the leading end of the N-th image. The CPU 306 analyzes the image density (gradation value) of the image data corresponding to the position (place) where the contamination is liable to occur.

A region obtained by adding, to the above positions, a margin obtained in consideration of positional variation of the recording material P with respect to the conveyance direction is the predetermined position. Therefore, in this embodiment, in the case where the image density of the image on the first side at the predetermined position is a predetermined threshold or more, the formation of the sheet interval patch in the sheet interval immediately before the second side of the recording material P is prevented.

Table 1 shows a result of an experiment for verifying ease of occurrence (appearance) of the back contamination depending on the image density of the first side image at the predetermined position.

TABLE 1

| FSI*1 | 0%*2 | 25%*3 | 50%*4 | 100%*5 |
|---|---|---|---|---|
| IR*6 | 1 | 2 | 3 | 4 |

*1"FSI represents the first side image.
*2"0%" represents the image ratio of 0%.
*3"25%" represents the image ratio of 25% of Y-halftone image (O.D. = 0.3).
*4"50%" represents the image ratio of 50% of Y-halftone image (O.D. = 0.5).
*5"100%" represents the image ratio of 100% of Y-solid image.
*6"IR" represents an image rank from "0" (not occurred) to "4" (very conspicuous) via "2" (limit level).

Table 1 is the result of the experiment of the case where the sheet interval patch is a single color of black and the first side image is a single color of yellow. The reflection density (O.D.) of the sheet interval patch on the intermediary transfer belt 40 was 0.3. A level of the back contamination after the sheet interval patch passes through the secondary transfer portion N2 and then the secondary transfer roller 60 is rotated through one full turn was compared.

Here, a value of the reflection density of the sheet interval patch is obtained by transferring the patch onto the paper under the same condition as that in a normal print operation and then by measuring the reflection density of the patch on the paper at its central portion and is not the reflection density at the back contamination position on the image to be formed immediately after the sheet interval. In order to detect a density fluctuation for performing the sheet interval density adjusting operation during the continuous printing, the sheet interval patch with the reflection density of 0.2-0.6 in which the density fluctuation is liable to occur may preferably be formed. However, in the image forming apparatus 100 in this embodiment, it was found that when the reflection density sheet interval patch exceeds 0.3, the amount of the toner deposited on the secondary transfer roller 60 starts to increase and thus the back contamination level is out of a tolerable range irrespective of the condition. For that reason, in this embodiment, the reflection density of the sheet interval patch was set at 0.3.

As the recording material P, an A4-sized copy/laser beam printer paper ("CS814", available from Canon K.K.) was used. As the reflection density measuring device, the above-described RD-918 (X-Rite Inc.) was used. Evaluation of the image rank shown in Table 1 was made by eye observation at the predetermined position. The level "2" was set as a tolerable limit of the back contamination level, and the level where the back contamination cannot be recognized at all was "0". Further, in Table 1, as the first side image density, the value obtained by transferring the image on the paper and then by measuring the central portion density on the paper at the predetermined position and the print ratio obtained from the associated image information are shown.

From the result of Table 1, it is understood that when the sheet interval patch has the same density, the back contamination level becomes worse with a higher toner density of the image formed on the first side of the paper. Further, in the case where the yellow image is formed on the first side, it is understood that when the halftone image with the reflection density of 0.5 or more is formed, the back contamination level is out of the tolerable range.

Thus, by controlling the timing when the sheet interval patch is formed, it becomes possible to effect the both-side printing excellent in productivity and density stability without causing the back contamination. In the image forming apparatus 100 in this embodiment, even when the sheet interval patch formation in the sheet interval immediately before the second side image is prevented, the influence on the density stability is a negligible degree. However, in the case where there is a need to form the sheet interval patch at a higher frequency, e.g., in almost all sheet intervals, the go/no-go of the sheet interval patch formation is discriminated on the basis of the image information of the image formed on the first side, so that the frequency of the sheet interval patch formation can be increased. For example, in the case where the halftone image with the reflection density of 0.5 or more is formed at the predetermined position of the first side image as described above, the sheet interval patch formation in the sheet interval immediately before the second side image can be prevented.

703. Control on the Basis of Sheet Interval Patch Detection Result

Referring again to FIG. 7, in step 5, by the control of the CPU 306, the image forming portion 307 forms the sheet interval patch at a predetermined density on the intermediary transfer belt 40. The image forming condition of the sheet interval patch was the same as the normal image forming condition on the intermediary transfer belt 40. In step 6, the CPU 306 calculates the patch density from the result of the patch of each color detected by the density sensor 90 in the above-described manner.

In step 7, the CPU 306 calculates a difference between a calculated value of the sheet interval patch density and an ideal density. In the present invention, a manner of determining the ideal density is not particularly limited. For example, a predetermined density may be stored as the ideal density in the ROM 310, and a result of the sheet interval patch density calculation immediately after the job start may also be stored as the ideal density in the RAM 309 for each job. In this embodiment, for the purpose of improving the image density stability in the job, the patch density measurement result immediately after the start of the job is used as the ideal density. In step 8, the CPU 306 determines a correction amount, depending on the difference calculated in the step 7, of the image forming condition to be corrected for the fourth and later images. In this embodiment, the correction of the image forming condition in proportion to the difference of the patch density is made but the density correcting method itself is not particularly limited in the present invention. For example, the correction amount may also be calculated on the basis of a specular reflection light quantity ratio of the patch to the intermediary transfer belt 40.

In the image forming apparatus 100 in this embodiment, the correction amount of the image forming condition was determined by using proportional-plus-integral control which is not readily affected by an accidental fluctuation and in which the correction amount is asymptotic to a target value, not by using so-called proportional control in which all the differences from the ideal density calculated in the step 7 are intended to be corrected at one time. As a specific image forming condition, a laser/scanner light emission amount table with respect to image data stored in the RAM 309 for each color is corrected. However, another image forming condition such as the charging bias or the developing bias may also be corrected.

Finally, in step 9, the CPU 306 controls the image forming portion 307 in accordance with the image forming condition determined in the step 8, thus executing the image formation.

After the step 9, the sequence is returned to the step 1, in which the discrimination as to whether or not the remaining print number is 4 sheets or more and a similar operation is repeated until the remaining print number is less than 4 sheets.

In the case where the remaining print number is less than 4 sheets in the step 1, the CPU 306 discriminates in step 2 whether or not during the print job. In the step 2, in the case of during the print job, the sequence is returned to the step 1, and in the case of not during the print job, the sequence is ended.

As described above, according to this embodiment, it is possible to improve the productivity and the density stability while suppressing the contamination of the recording material with the test image formed between an image and a subsequent image during the continuous image formation.

The go/no-go of the sheet interval patch formation in the sheet interval immediately before the image to be formed on the second side may preferably be discriminated on the basis of the image information of the image formed on the first side of the recording material P. However, as described above, the go/no-go of the sheet interval patch formation may also be discriminated only depending on whether or not the image subsequent to the sheet interval patch is to be formed on the second side.

In this embodiment, the sheet interval density adjusting operation was performed in the sheet interval region during the continuous print job. However, the present invention is not limited thereto but may also employ a constitution in which the sheet interval patch is formed similarly as in this embodiment irrespective of the number of output sheets of the print job and when a time between print jobs is short, the density adjusting operation is performed by using a detection result of the sheet interval patch during the print job executed immediately before the sheet interval patch formation.

In this embodiment, the case where the first side image is yellow and the sheet interval patch is black was described. However, although there is a variation in ease of occurrence of the back contamination of the paper depending on a combination of the first side image color and the sheet interval patch color, an effect of the present invention is not limited to that in the case of the above combination. For example, the go/no-go of the sheet interval patch formation can be discriminated on the basis of the first side image color and the toner amount per unit area and in this case, a threshold of the toner amount per unit area can be changed depending on the color of the image on the first side. For example, in the case where the first side image is the yellow image on which the back contamination is liable to be conspicuous, the threshold of the toner amount per unit area can be relatively decreased, and in the case of other colors, the threshold of the toner amount per unit area can be relatively increased.

Further, in this embodiment, as described with reference to FIG. 4, the single patch of each color is disposed in the single sheet interval region and is used as a fixed gradation patch of each color but the present invention is not limited thereto. In the case where a tendency of the density fluctuation in the image forming apparatus is relatively strong and a real-time property for adjustment is required, as in this embodiment, it is desirable that the frequency of the adjustment is increased by using the fixed gradation patch. On the other hand, in the case where the tendency of the density fluctuation in the image forming apparatus is relatively moderate and the stability of the density-gradation characteristic is intended to be further improved as a whole, different gradation patches may be formed in different sheet interval regions and then the density may be adjusted with a plurality of gradation levels. Further, in the case where a short-period density fluctuation occurs periodically and a long-period density fluctuation also occurs, an average of detection results of the same gradation patch in the plurality of the sheet interval regions is treated as a single density detection result and thus the short-period periodical component is placed in a negligible state and then the density adjusting operation may also be performed.

Embodiment 2

Another embodiment of the present invention will be described. In this embodiment, basic constitution and operation of the image forming apparatus are the same as those in Embodiment 1. Therefore, elements having the same or corresponding functions and constitutions as those in Embodiment 1 are represented by the same reference numerals or symbols and will be omitted from detailed description.

In this embodiment, in the case where an output image which reaches the secondary transfer portion N2 during rotation of the secondary transfer roller 60 through a plurality of turns after the passing of the sheet interval patch is to be transferred onto the second side, and in addition, an output of the sensor for detecting the temperature or the humidity disposed in the image forming apparatus satisfies a predetermined condition, the formation of the sheet interval patch in the sheet interval is prevented. In this embodiment, particularly, the go/no-go of the sheet interval patch formation in the sheet interval (region) immediately before the image to be transferred onto the second side of the recording material P is discriminated on the basis of information on weight(-basis) absolute humidity detected by the temperature/humidity sensor 89 (FIG. 2) which is the temperature/humidity detecting means as an environment detecting means provided in the image forming apparatus 100.

In this embodiment, a hardware constitution of the image forming apparatus 100 is the same as that in Embodiment 1 but the sheet interval patch formation go/no-go discrimination processing (step 3 in FIG. 7) in the sheet interval density adjusting operation is different from that in Embodiment 1.

Figure 10:
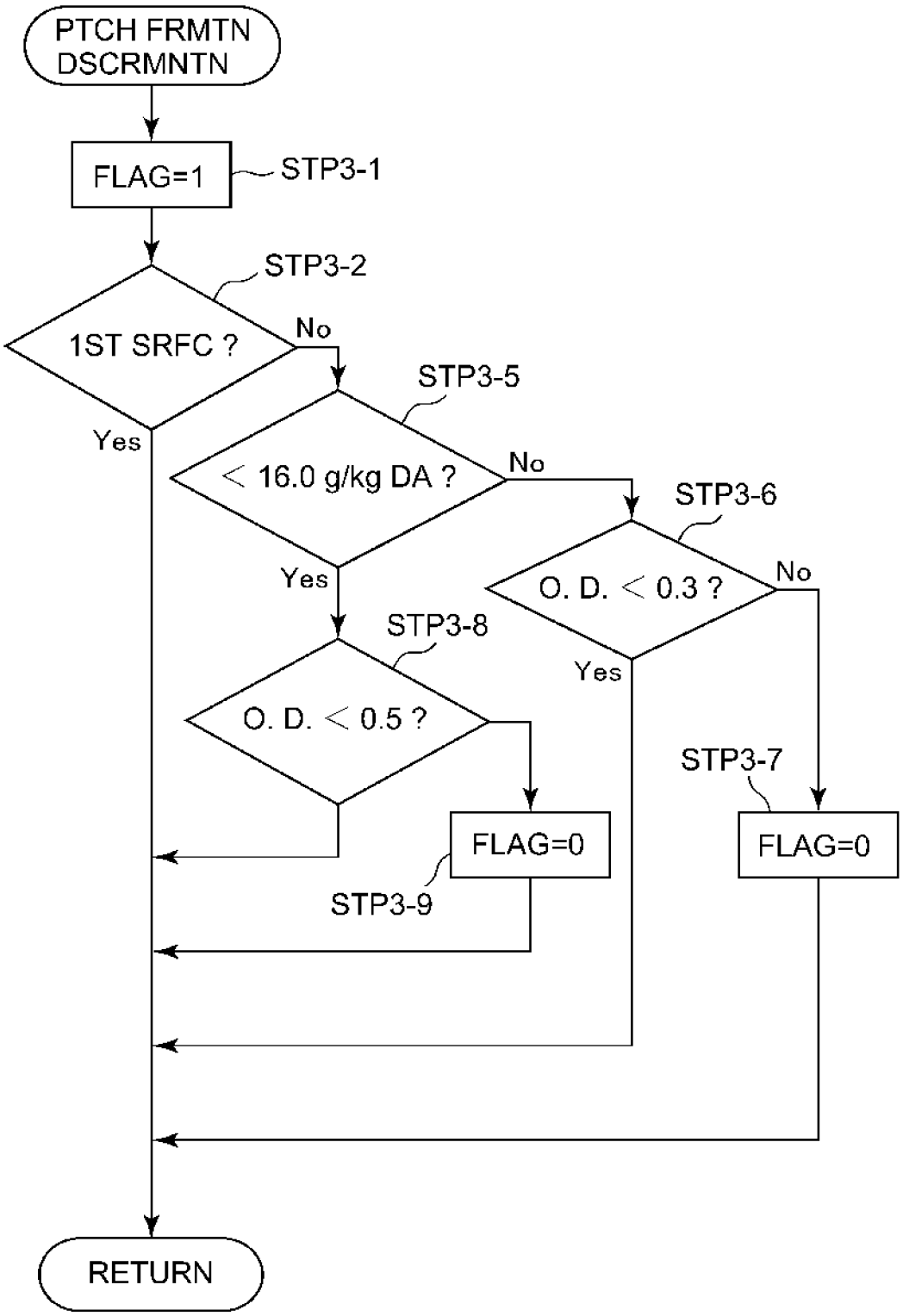
FIG. 10 is a flow chart of another example of the sheet interval patch formation go/no-go discrimination process.

FIG. 10 is a flow chart of the sheet interval patch formation go/no-go discrimination processing which is another subroutine executed in the step 3 in the flow chart of FIG. 7.

Further, the steps 3-1 and 3-2 similar to those in Embodiment 1 are carried out. Thereafter, in the case where the image immediately after the sheet interval patch is the image to be transferred onto the second side of the recording material P in the step 3-2, the CPU 306 checks, in step 3-5, the weight absolute humidity calculated by the temperature/humidity sensor 89 in an ambience in each of an inside and an outside of the image forming apparatus 100. In the case where the checked weight absolute humidity is 16.0 g/kgDA or more, in step 3-6, the CPU 306 checks image information of the first side image on the recording material P at the predetermined position. In the case where the resultant image density is 0.3 or more as the reflection density, the CPU 306 sets the sheet interval patch formation flag in the RAM 309 at "0" in step 3-7. Then, the subroutine is ended and the sequence goes to the step 4 of the flow chart of FIG. 7. As a result, the sheet interval patch formation in the sheet interval immediately before the second side image is prevented. Further, in step 3-6, in the case where the image density is less than 0.3 as the reflection density, the CPU 306 keeps the sheet interval patch formation flog at "1" in order to form the sheet interval patch. Then, the subroutine is ended and the sequence goes to the step 4 of the flow chart of FIG. 7. In the image forming apparatus 100 in this embodiment, the image density corresponding to the reflection density of 0.3 was 25% as the print ratio.

On the other hand, in the step 3-5, in the case where the weight absolute humidity is less than 16.0 g/kgDA, the CPU 306 checks, in step 3-8, the image information of the first side image on the recording material P at the predetermined position. In this case, compared with a high temperature/high humidity environment, the back contamination of the paper is not readily generated and therefore the process similar to the above-described process is effected with the image density threshold corresponding to the reflection density of 0.5. That is, when the image density is less than 0.5 as the reflection density, the sheet interval patch formation flag in the RAM 309 is kept at "1". On the other hand, when the image density is 0.5 or more as the reflection density, in step 3-9, the sheet interval patch formation flag in the RAM 309 is set at "0", so that the sheet interval patch formation immediately before the second side image is prevented.

Table 2 shows, similarly as in the case of Table 1 in Embodiment 1, a result of an experiment for verifying ease of occurrence of the back contamination depending on the humidity in the case where the sheet interval patch is a single color of black, the first side image is single color of yellow and the reflection density (O.D.) of the sheet interval patch is 0.3. The weight(-basis) absolute humidity was 1.1 g/kgDA in a low temperature/low humidity environment, 8.9 g/kgDA in a normal environment and 21.1 g/kgDA in a high temperature/high humidity environment. The recording material P, the measuring device and the evaluation method are the same as those in the case of Table 1 in Embodiment 1.

TABLE 2

| FSI*1 | WAH*2 | 0%*3 | 25%*4 | 50%*5 | 100%*6 |
|---|---|---|---|---|---|
| IR*7 | 1.1 | 1 | 2 | 3 | 4 |
| | 8.9 | 1 | 2 | 3 | 4 |
| | 21.1 | 2 | 3 | 4 | 4 |

*1"FSI represents the first side image.
*2"WAH" represents the weight absolute humidity (8/kgDA).
*3"0%" represents the image ratio of 0%.
*4"25%" represents the image ratio of 25% of Y-halftone image (O.D. = 0.3).
*5"50%" represents the image ratio of 50% of Y-halftone image (O.D. = 0.5).
*6"100%" represents the image ratio of 100% of Y-solid image.
*7"IR" represents an image rank from "0" (not occurred) to "4" (very conspicuous) via "2" (limit level).

From Table 2, it is understood that the back contamination of the recording material is liable to occur (appear) in the high temperature/high humidity environment. This may be attributable to the following difference in state of the toner. That is, in the high temperature/high humidity environment, a macroscopic electric charge amount per weight (Q/M) is lowered by moisture absorption and toner particles which have almost no electric charge or which are charged to an opposite polarity are contained in a large amount compared with other environment. As a result, even when the negative DC voltage is applied to the secondary transfer roller 60 at the time when the sheet interval patch passes through the secondary transfer portion N2, the amount of the toner deposited on the secondary transfer roller 60 cannot be completely suppressed. As a result, compared with other environments, in the high temperature/high humidity environment, the amount of the toner deposited on the secondary transfer roller 60 is large, so that the deposited toner is liable to appear as the back contamination of the recording material P.

In this embodiment, under the condition in which the image rank in Table 2 is 3 or less, the sheet interval patch formation in the sheet interval immediately before the image is formed (transferred) on the second side is permitted.

In this embodiment, the go/no-go of the sheet interval patch formation is discriminated on the basis of the first side image information and the weight absolute humidity but may also be discriminated on the basis of only the weight absolute humidity. For example, in the case where the weight absolute humidity is a predetermined threshold or more, irrespective of the first side image information, the sheet interval patch formation in the sheet interval immediately before the second side image can be prevented. Further, in this embodiment, the weight absolute humidity is detected as environmental information of the image forming apparatus 100 but it can be said that in a high temperature state, the back contamination is more liable to appear than in a low temperature state, so that it is also possible to discriminate the go/no-go of the sheet interval patch formation depending on only the temperature information.

As described above, in this embodiment, by controlling the timing of the sheet interval patch formation by using the detection result of the ambient environment information of the image forming apparatus 100, a possibility of the occurrence of the back contamination depending on the environment is estimated, so that it is possible to improve the productivity and the density stability while suppressing the back contamination.

Embodiment 3

Another embodiment of the present invention will be described. In this embodiment, basic constitution and operation of the image forming apparatus are the same as those in Embodiment 1. Therefore, elements having the same or corresponding functions and constitutions as those in Embodiment 1 are represented by the same reference numerals or symbols and will be omitted from detailed description.

In this embodiment, in the case where an output image which reaches the secondary transfer portion N2 during rotation of the secondary transfer roller 60 through a plurality of turns after the passing of the sheet interval patch is to be transferred onto the second side, and in addition, a type or a surface property of the recording material P onto which the output image is to be transferred satisfies a predetermined condition, the formation of the sheet interval patch in the sheet interval is prevented. In this embodiment, particularly, the go/no-go of the sheet interval patch formation in the sheet interval (region) immediately before the image to be transferred onto the second side of the recording material P is discriminated on the basis of a surface state of the recording material P detected by a media sensor 88 (FIG. 2) as a surface property detecting means provided in the image forming apparatus 100.

In this embodiment, a hardware constitution of the image forming apparatus 100 is the same as that in Embodiment 1 but the sheet interval patch formation go/no-go discrimination processing (step 3 in FIG. 7) in the sheet interval density adjusting operation is different from that in Embodiment 1.

In this embodiment, as the surface state of the recording material P, a surface roughness (surface property) of the recording material P is detected by using the media sensor 88 (FIG. 2). The media sensor 88 used in this embodiment discriminates surface smoothness on the basis of a result of image pickup, by a CMOS sensor, of a shadow (image) generated due to surface unevenness of the recording material P. In this embodiment, the image read by the CMOS sensor is digital-processed into 8×8 pixels and is converted into a white/black binary image. When a smooth recording material P is used, a degree of the unevenness is small and therefore almost no shadow is generated, so that the image after the processing becomes uniform (white in this case). On the other hand, the recording material P having low surface smoothness has a ratio (white ratio), of 50%, of the white image to the processed image.

As the surface property detecting means another media sensor or the like of the type in which, e.g., an amount of variation in amount of light reflected from the surface of the recording material P is measured and thus surface roughness of the recording material P is discriminated may also be used.

Figure 11:
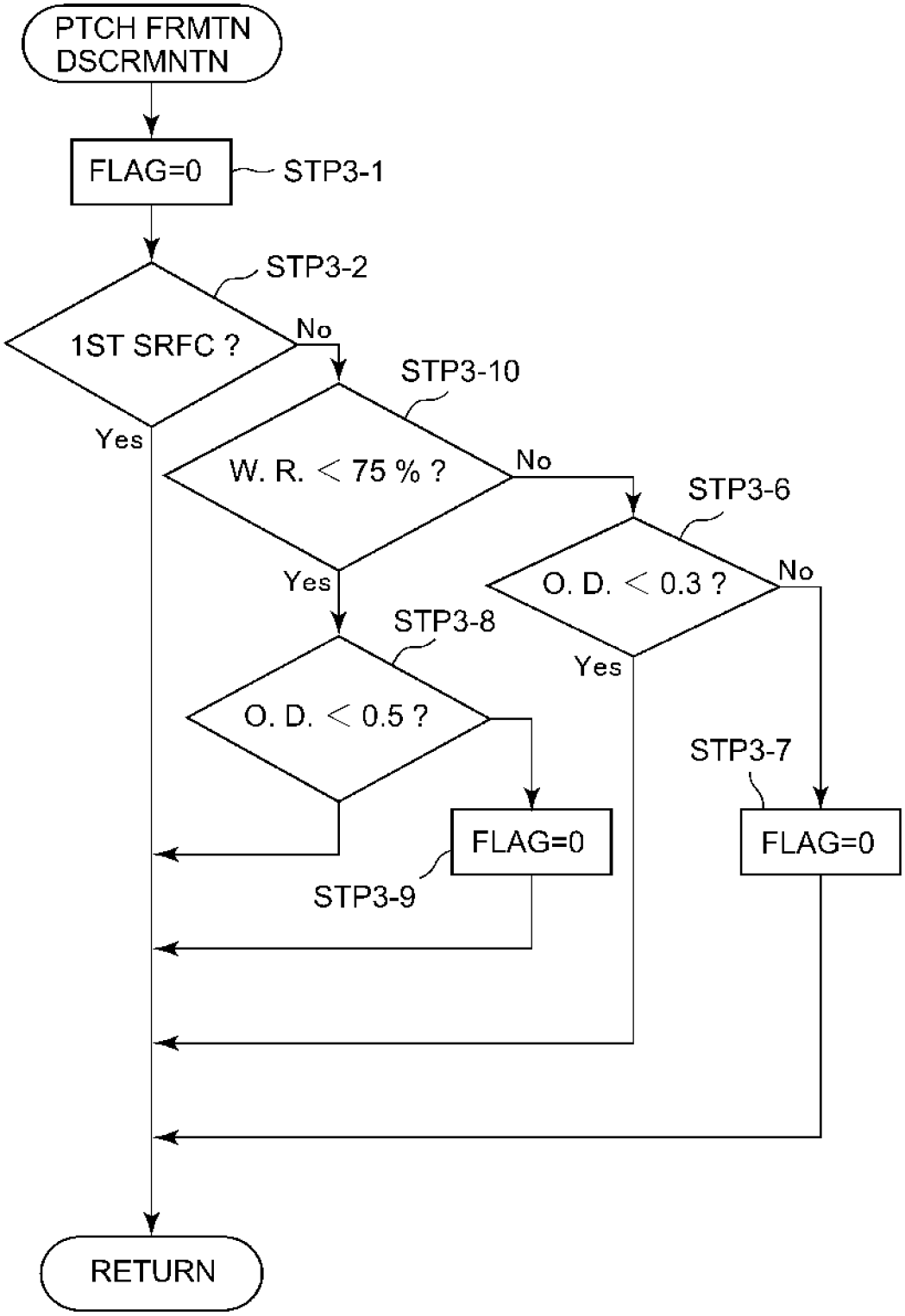
FIG. 11 is a flow chart of another sheet interval patch formation go/no-go discrimination process.

FIG. 11 is a flow chart of the sheet interval patch formation go/no-go discrimination processing which is another subroutine executed in the step 3 in the flow chart of FIG. 7.

Further, the steps 3-1 and 3-2 similar to those in Embodiment 1 are carried out. Thereafter, in the case where the image immediately after the sheet interval patch is the image to be transferred onto the second side of the recording material P in the step 3-2, the CPU 306 checks, in step 3-10, a detection result of the media sensor 88. The media sensor 88 detects the surface roughness of the recording material P stopped by the registration roller pair 34 after the print job is started. In this case, the surface roughness is the white ratio of the image obtained by digital-processing the pick-up image by the above-described CMOS sensor. In the case where the white ratio is 75% or more, in step 3-6, the CPU 306 checks image information of the first side image on the recording material P at the predetermined position. In the case where the resultant image density is 0.3 or more as the reflection density, the CPU 306 sets the sheet interval patch formation flag in the RAM 309 at "0" in step 3-7. This is because even when the image density at the predetermined position is 0.3 as the reflection density, the back contamination occurs conspicuously on high gloss paper with a high white ratio of the digital image. Then, the subroutine is ended and the sequence goes to the step 4 of the flow chart of FIG. 7. As a result, the sheet interval patch formation in the sheet interval immediately before the second side image is prevented. Further, in step 3-6, in the case where the image density is less than 0.3 as the reflection density, the CPU 306 keeps the sheet interval patch formation flog at "1" in order to form the sheet interval patch. Then, the subroutine is ended and the sequence goes to the step 4 of the flow chart of FIG. 7. In the image forming apparatus 100 in this embodiment, the image density corresponding to the reflection density of 0.3 was 25% as the print ratio.

On the other hand, in the step 3-10, in the case where the white ratio is less than 75%, the CPU 306 checks, in step 3-8, the image information of the first side image on the recording material P at the predetermined position. In this case, on the recording material P having a relatively rough surface or on the rough recording material P, the back contamination of the paper is not readily generated and therefore the process similar to the above-described process is effected with the image density threshold corresponding to the reflection density of 0.5. That is, when the image density is less than 0.5 as the reflection density, the sheet interval patch formation flag in the RAM 309 is kept at "1". On the other hand, when the image density is 0.5 or more as the reflection density, in step 3-9, the sheet interval patch formation flag in the RAM 309 is set at "0", so that the sheet interval patch formation in the sheet interval immediately before the second side image is prevented.

Table 3 shows, similarly as in the case of Table 1 in Embodiment 1, a result of an experiment for verifying ease of occurrence of the back contamination depending on the surface state of the recording material P in the case where the sheet interval patch is a single color of black, the first side image is single color of yellow and the reflection density (O.D.) of the sheet interval patch is 0.3. In this embodiment, three types of the recording materials P capable of being discriminated by the media sensor 88 were used and were compared with respect to ease of conspicuousness of the back contamination. With respect to the surface roughness, Fox River Bond is roughest and Glossy Presentation Paper is smoothest. Further, the white ratio (ratio of the white image to the processed image) as the detection result of the media sensor 88 in Table 3 was represented by "W.R.". The recording material P, the measuring device and the evaluation method are the same as those in the case of Table 1 in Embodiment 1.

TABLE 3

| FSI*1 | PT*2 | 0%*3 | 25%*4 | 50%*5 | 100%*6 |
|---|---|---|---|---|---|
| IR*7 | FRB*8 | 1 | 1 | 3 | 4 |
| | CS814*9 | 1 | 2 | 3 | 4 |
| | Gpp*10 | 2 | 3 | 4 | 4 |

*1"FSI represents the first side image.
*2"PT" represents the paper type.
*3"0%" represents the image ratio of 0%.
*4"25%" represents the image ratio of 25% of Y-halftone image (O.D. = 0.3).
*5"50%" represents the image ratio of 50% of Y-halftone image (O.D. = 0.5).
*6"100%" represents the image ratio of 100% of Y-solid image.
*7"IR" represents an image rank from "0" (not occurred) to "4" (very conspicuous) via "2" (limit level).
*8"FRB" represents Fox River Bond (90 gsm) with W.R > of 50%.
*9"CS814" represents CS814 (81.4 gsm) with W.R. of 65%.
*10"GPP" represents Glossy Presentation Paper (120 gsm) with W.R. of 90%.

From Table 3, it is understood that particularly under a condition in which the amount of the toner of the image to be formed on the first side is small, the back contamination is not readily generated with a higher surface roughness of the recording material P. This shows that even in the case where the toner is deposited on the secondary transfer roller 60 at the same level, a degree of adhesiveness between the recording material P and the secondary transfer roller 60 varies depending on the surface property of the recording material P and thus the amount of physical toner deposition is increased with higher smoothness of the recording material P. On the other hand, in the case where the amount of the toner of the image formed on the first side is large, the recording material P has the smooth surface and in addition, an affinity among toner particles is high and therefore a difference in surface state of the recording material P is not reflected in the level of the back contamination.

In this embodiment, under the condition in which the image rank in Table 3 is 3 or less, the sheet interval patch formation in the sheet interval immediately before the image is formed (transferred) on the second side is permitted.

In this embodiment, the go/no-go of the sheet interval patch formation is discriminated on the basis of the first side image information and surface state of the recording material P but in the case where the surface property of the recording material P is smooth, a constitution in which the sheet interval patch is not formed in the sheet interval immediately before the second side image irrespective of the first side image information may also be employed. For example, in the case where the white ratio indicating the surface property (surface roughness) of the recording material P is a predetermined threshold or more, irrespective of the first side image information, the sheet interval patch formation in the sheet interval immediately before the second side image can be prevented. Further, in this embodiment, the image forming apparatus 100 including the media sensor 88 is described but a similar discrimination may also be made by using a print mode in which the image forming apparatus 100 is operable. That is, e.g., in the case where a rough paper mode is selected as the print mode, the CPU 306 as a (paper) type detecting means discriminates that the recording material P used is rough paper. Similarly, e.g., in the case where a high gloss mode is selected as the print mode, the CPU 306 discriminates that the recording material P used is high-glossy paper having high surface smoothness. Further, the CPU 306 can discriminate the go/no-go of the sheet interval patch formation depending on its discrimination result similarly as in this embodiment. Thus, in the case where the image forming apparatus 100 is operable in a plurality of image forming modes in which the types of the recording materials used are different from each other, the go/no-go of the sheet interval patch formation can be discriminated in the following manner. That is, in the case where the output image which reaches the secondary transfer portion during rotation of the secondary transfer roller through a predetermined number of turns after the passing of the sheet interval patch is to be transferred (formed) on the second side and in addition, a predetermined image forming mode of the plurality of image forming modes is selected, it is possible to prevent the formation of the sheet interval patch in the sheet interval.

As described above, in this embodiment, by controlling the timing of the sheet interval patch formation by using the type or the surface property of the recording material 100, a possibility of the occurrence of the back contamination depending on the type or the surface property of the recording material P is estimated, so that it is possible to improve the productivity and the density stability while suppressing the back contamination.

Embodiment 4

Another embodiment of the present invention will be described. In this embodiment, basic constitution and operation of the image forming apparatus are the same as those in Embodiment 1. Therefore, elements having the same or corresponding functions and constitutions as those in Embodiment 1 are represented by the same reference numerals or symbols and will be omitted from detailed description.

In this embodiment, in the case where an output image which reaches the secondary transfer portion N2 during rotation of the secondary transfer roller 60 through a plurality of turns after the passing of the sheet interval patch is to be transferred onto the second side, and in addition, an amount of use of the secondary transfer roller 60 satisfies a predetermined condition, the formation of the sheet interval patch in the sheet interval is prevented. In this embodiment, particularly, the go/no-go of the sheet interval patch formation in the sheet interval (region) immediately before the image to be transferred onto the second side of the recording material P is discriminated on the basis of, as an operation state of the image forming apparatus 100, the number of sheets passed through the secondary transfer roller 60.

In this embodiment, a hardware constitution of the image forming apparatus 100 is the same as that in Embodiment 1 but the sheet interval patch formation go/no-go discrimination processing (step 3 in FIG. 7) in the sheet interval density adjusting operation is different from that in Embodiment 1.

Specifically, the CPU 306 discriminates the go/no-go of the sheet interval patch formation depending on the number of sheets, passed through the secondary transfer roller 60, stored in the RAM 309 functioning as a counter used as an operation state detecting means.

Figure 12:
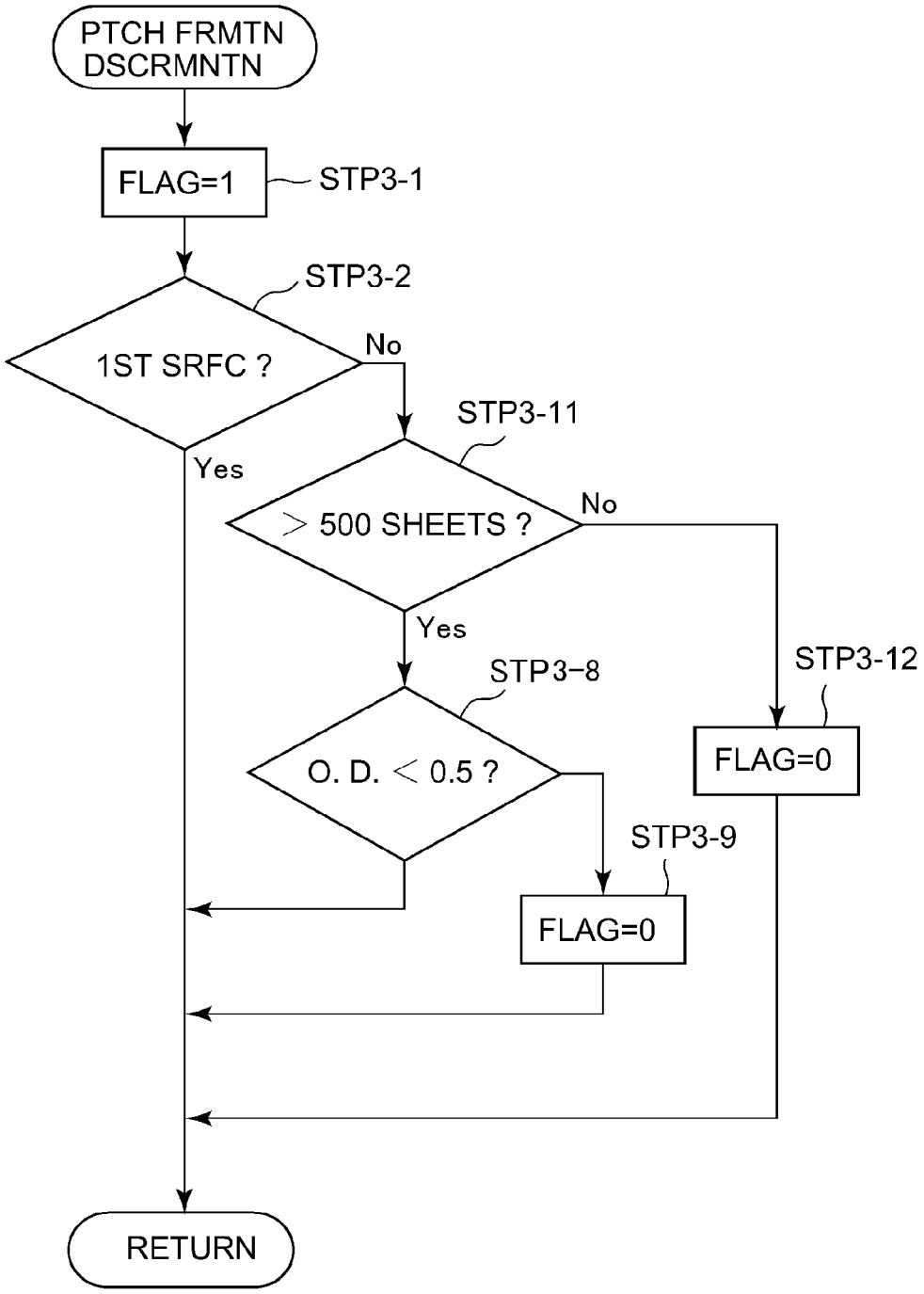
FIG. 12 is a flow chart of another sheet interval patch formation go/no-go discrimination process.

FIG. 12 is a flow chart of the sheet interval patch formation go/no-go discrimination processing which is another subroutine executed in the step 3 in the flow chart of FIG. 7.

Further, the steps 3-1 and 3-2 similar to those in Embodiment 1 are carried out. Thereafter, in the case where the image immediately after the sheet interval patch is the image to be transferred onto the second side of the recording material P in the step 3-2, the CPU 306 reads, in step 3-11, the number of sheets, passed through the secondary transfer roller 60, stored in the RAM 309. In the case where the number of sheets passed through the secondary transfer roller 60 is 500 sheets or less, the CPU 306 sets the sheet interval patch formation flag in the RAM 309 at "0" in step 3-12. Then, the subroutine is ended and the sequence goes to the step 4 of the flow chart of FIG. 7. As a result, the sheet interval patch formation in the sheet interval immediately before the second side image is prevented.

On the other hand, in the step 3-11, in the case where the number of sheets passed through the secondary transfer roller 60 exceeds 500 sheets, the CPU 306 checks, in step 3-8, the image information of the first side image of the recording material P at the predetermined position. Then, in the case where the image density is 0.5 or more as the reflection density, the CPU 306 sets the sheet interval patch formation flag in the RAM 309 at "0" in step 3-9. Thereafter, the subroutine is ended and the sequence goes to the step 4 in the flow chart of FIG. 7. Further, in step 3-8, in the case where the image density is less than 0.5 as the reflection density, the CPU 306 keeps the sheet interval patch formation flog at "1" in order to form the sheet interval patch. Then, the subroutine is ended and the sequence goes to the step 4 of the flow chart of FIG. 7. In the image forming apparatus 100 in this embodiment, the image density corresponding to the reflection density of 0.5 was 50% as the print ratio.

In this embodiment, as the secondary transfer roller 60, a foam rubber roller having a single layer was used. Further, in this embodiment, as the intermediary transfer belt 40, a resin belt having high surface smoothness was used. The surface smoothness of the intermediary transfer belt 40 can be maintained at a substantially constant level by the use of the image forming apparatus 100, but the surface property of the secondary transfer roller 60 has a tendency that the surface of the secondary transfer roller 60 is roughest immediately after start of use of the secondary transfer roller 60 and then smoothness thereof is increased due to abrasion or clogging with the use of the secondary transfer roller 60. Even in the case where an electric field is formed so as to prevent the negative toner from being transferred onto the secondary transfer roller 60 during the passing of the sheet interval patch through the secondary transfer portion N2, a difference in speed is generated between the intermediary transfer belt 40 and the secondary transfer roller 60. For that reason, the toner is scraped and moved toward the secondary transfer roller 60 having a rough surface and thus is liable to be deposited on the secondary transfer roller 60. That is, immediately after the start of the use of the secondary transfer roller 60, the toner is liable to be deposited on the secondary transfer roller 60 and an amount of deposition tends to decrease with the use.

Table 4 shows, similarly as in the case of Table 1 in Embodiment 1, a result of an experiment for verifying ease of occurrence of the back contamination depending on the number of sheets passed through the secondary transfer roller 60 in the case where the sheet interval patch is a single color of black, the first side image is single color of yellow and the reflection density (O.D.) of the sheet interval patch is 0.3. The number of sheets passed through the secondary transfer roller 60 was immediately after the use of the secondary transfer roller 60 ("0"), 500 sheets ("500") and 1000 sheets ("1000"). The recording material P, the measuring device and the evaluation method are the same as those in the case of Table 1 in Embodiment 1.

TABLE 4

| FSI*1 | NOS*2 | 0%*3 | 25%*4 | 50%*5 | 100%*6 |
|---|---|---|---|---|---|
| IR*7 | 0 | 3 | 3 | 4 | 4 |
| | 500 | 2 | 3 | 3 | 4 |
| | 1000 | 1 | 2 | 3 | 4 |

*1"FSI represents the first side image.
*2"NOS" represents the number of sheets based through the secondary transfer roller.
*3"0%" represents the image ratio of 0%.
*4"25%" represents the image ratio of 25% of Y-halftone image (O.D. = 0.3).
*5"50%" represents the image ratio of 50% of Y-halftone image (O.D. = 0.5).
*6"100%" represents the image ratio of 100% of Y-solid image.
*7"IR" represents an image rank from "0" (not occurred) to "4" (very conspicuous) via "2" (limit level).

From Table 4, it is understood that the back contamination is liable to occur immediately after the use of the secondary transfer roller 60 is started and a level of the back contamination is improved (decreased in numerical value) with the use. The level of the back contamination was not changed largely after 1000 sheets and later.

In this embodiment, under the condition in which the image rank in Table 4 is 3 or less, the sheet interval patch formation in the sheet interval immediately before the image is formed (transferred) on the second side is permitted.

In this embodiment, the go/no-go of the sheet interval patch formation is discriminated on the basis of the number of sheets passed through the secondary transfer roller 60 and the first side image information but immediately after the start of the use of the secondary transfer roller 60, there is no allowance for the back contamination irrespective of the first side image. Therefore, the go/no-go of the sheet interval patch formation may also be discriminated on the basis of only information on the number of sheets passed through the secondary transfer roller 60. For example, in the case where the number of sheets passed through the secondary transfer roller 60 is a predetermined threshold or less, irrespective of the first side image information, the sheet interval patch formation in the sheet interval immediately before the second side image can be prevented. Further, in this embodiment, the change in state of the secondary transfer roller 60 is estimated on the basis of the number of sheets passed through the secondary transfer roller 60 but the present invention is not limited to this method. For example, the number may also be replaced with the number of sheets passed through a main assembly of the image forming apparatus 100 depending on the constitution of the main assembly of the image forming apparatus 100. Alternatively, the number of turns of the secondary transfer roller 60 may also be used. Any number can be used when the number is an index correlated with the amount of use of the secondary transfer roller 60.

Further, in this embodiment, particularly, the influence of the change in state of the secondary transfer roller 60 with use on the ease of occurrence of the back contamination is conspicuous and therefore the amount of use of the secondary transfer roller 60 was described as an example. However, it would be considered that there arises the case where the influence of the change in state of another element, such as the intermediary transfer belt 40, of the image forming portion with use on the ease of occurrence of the back contamination is large depending on the constitution of the main assembly of the image forming apparatus 100. In such a case, depending on the change in state of the element with use, the sheet interval patch formation timing may also be controlled.

As described above, in this embodiment, by controlling the timing of the sheet interval patch formation by using the detection result of the operation state of the image forming apparatus 100, a possibility of the occurrence of the back contamination depending on the operation state is estimated, so that it is possible to improve the productivity and the density stability while suppressing the back contamination.

Other Embodiments

The present invention was described based on the specific embodiments but is not limited thereto.

In the above-described embodiments, the image forming apparatus of the intermediary transfer type was described but the present invention is not limited thereto.

Figure 13:
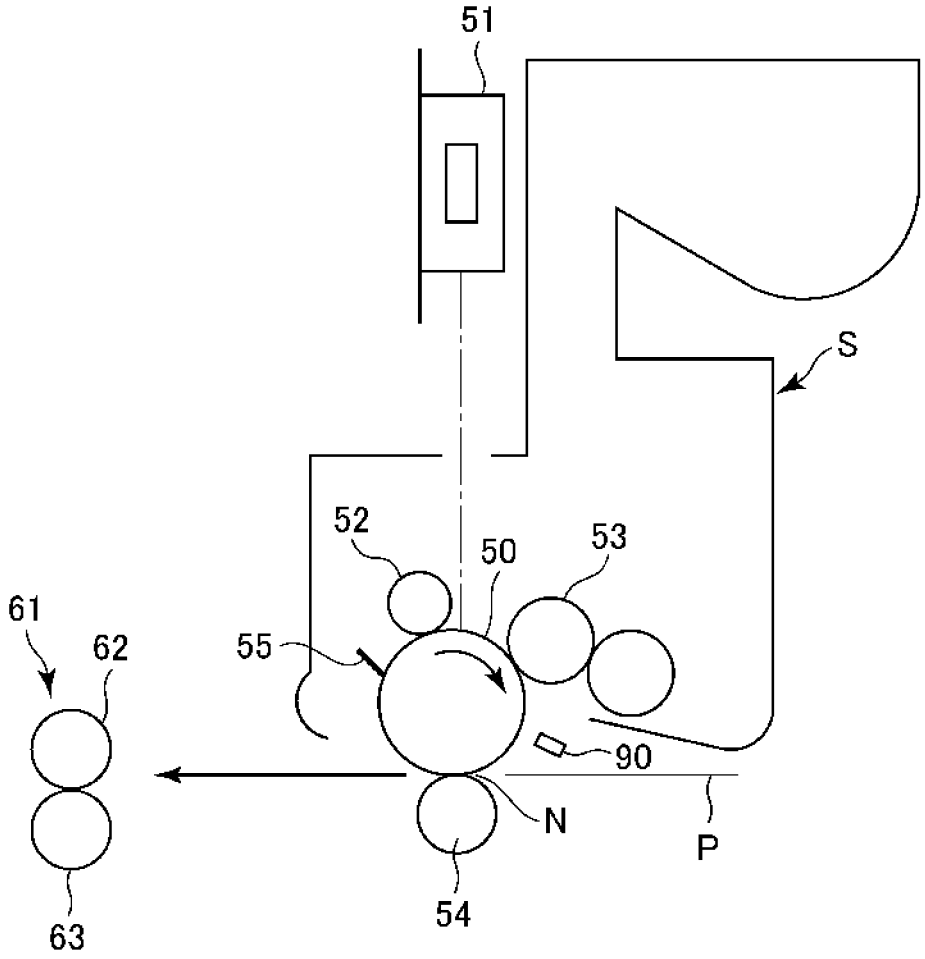
FIG. 13 is a sectional view showing a schematic structure of a principal part of an image forming apparatus in another embodiment.

FIG. 13 shows a schematic structure of a principal part of another image forming apparatus to which the present invention is applicable. In the image forming apparatus shown in FIG. 13, elements having the same or corresponding functions and constitutions as those in Embodiment 1 are represented by the same reference numerals or symbols. In the image forming apparatus of FIG. 13, the toner image formed on a photosensitive drum 50 is directly transferred onto the recording material P by a transfer roller 54. This image forming apparatus includes a conveying means (not shown) for conveying the recording material P, having thereon the toner image transferred on the first side, to a transfer portion N in order to transfer the toner image onto the second side of the recording material P. In such an image forming apparatus, the sheet interval patch is formed in the sheet interval and is detected by a density sensor 90 on the photosensitive drum 50 and then is used for controlling the image forming condition (such as density adjustment) in some cases. By the same mechanism as that of the occurrence of the back contamination of the recording material P by the secondary transfer roller 60 in the image forming apparatus 100 in the above-described embodiments, the back contamination of the recording material P by the transfer roller 54 can occur. Particularly, the back contamination at the time of the transfer of the image on the second side during the both-side printing becomes problematic. Therefore, also in such an image forming apparatus, the principle of the present invention can also be similarly applied. In the image forming apparatus, the transfer roller 54 is a rotatable transfer member for transferring the toner (member) from the photosensitive drum 50 onto the recording material P while nip-feeding the recording material P at the transfer portion N between itself and the photosensitive drum 50.

In this case, the CPU as the control means, included in the image forming apparatus, for controlling an operation for forming the test image of the toner in the sheet interval region between consecutive output images on the image bearing member can control the sheet interval patch formation timing in the following manner. That is, in the case where an output image which reaches the transfer portion N during a period from passing of a position of the sheet interval patch in a certain sheet interval through the transfer portion N until the transfer roller 54 is rotated through a predetermined number of turns is to be transferred onto the first side of the recording material P, formation of the sheet interval patch in the sheet interval is permitted. In other words, formation of the test image in the interval region, when a subsequent output image passing through the transfer portion N is to be transferred onto the first side of the recording material P, is permitted. On the other hand, in the case where an output image which reaches the transfer portion N during a period from passing of a position of the sheet interval patch in a certain sheet interval through the transfer portion N until the transfer roller 54 is rotated through a predetermined number of turns (more than zero) is to be transferred onto the second side of the recording material P, formation of the test image in the interval region interval is prevented. In other words, formation of the test image in the interval region, when a subsequent output image passing through the transfer portion N is to be transferred onto the second side of the recording material P, is prevented. Similarly as in the cases of the above-described embodiments, it is also possible to further add a condition for discriminating the go/no-go of the test image formation depending on the first side image information, the environment, the type of the recording material P or the like.

Figure 14:
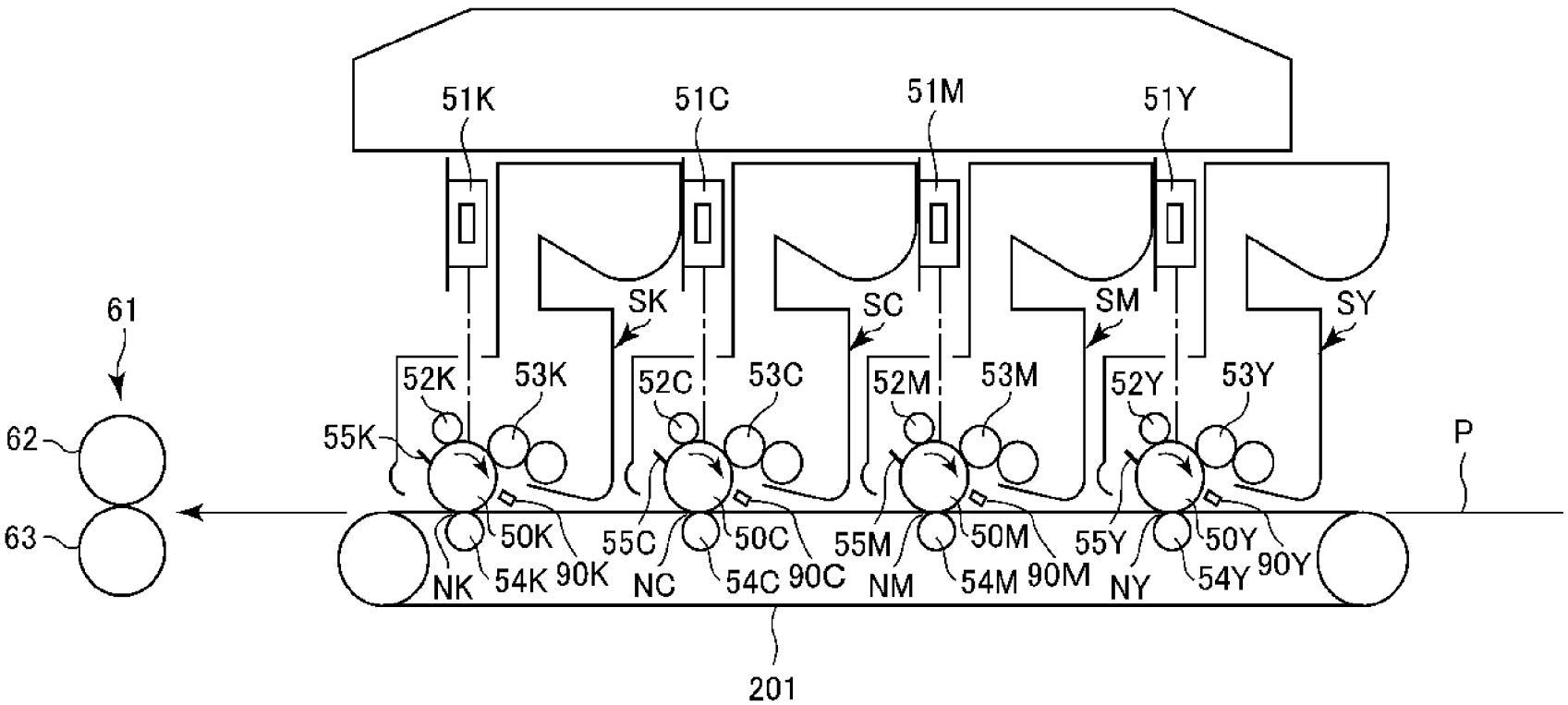
FIG. 14 is a sectional view showing a schematic structure of a principal part of an image forming apparatus in another embodiment.

FIG. 14 shows a schematic structure of a principal part of a further image forming apparatus to which the present invention is applicable. In the image forming apparatus shown in FIG. 14, elements having the same or corresponding functions and constitutions as those in Embodiment 1 are represented by the same reference numerals or symbols. The image forming apparatus of FIG. 14 is of the tandem type employing a direct transfer system. This image forming apparatus includes a rotatable recording material conveying (carrying) member 201 for carrying and conveying the recording material P in contact with the photosensitive drums 50. The toner image is directly transferred from each photosensitive drum 50 onto the recording material P carried on the recording material conveying member 201 by an associated transfer roller 54, as the transfer means, which is a rotatable roller-type transfer member. As the recording material conveying member 201, a recording material conveying belt having an endless belt shape or the like is used. For example, during full-color image formation, toner images of a plurality of colors are successively transferred superposedly onto the recording material P carried on the recording material conveying member 201. This image forming apparatus includes a conveying means (not shown) for carrying the recording material P, having thereon the toner image transferred on the first side, on the recording material conveying member 201 in order to transfer the toner image onto the second side of the recording material P. Also in such an image forming apparatus, the sheet interval patch is formed in the sheet interval on the photosensitive drum 50 and is detected by a density sensor 90 on the photosensitive drum 50 or after being transferred onto the recording material conveying member and thus is used for controlling the image forming condition (such as density adjustment or color misregistration correction) in some cases. By the same mechanism as that of the occurrence of the back contamination of the recording material P by the secondary transfer roller 60 in the image forming apparatus 100 in the above-described embodiments, the back contamination of the recording material P by the recording material conveying member 201 can occur. Particularly, the back contamination at the time of the transfer of the image on the second side during the both-side printing becomes problematic. Therefore, also in such an image forming apparatus, the principle of the present invention can also be similarly applied.

In the direct transfer system in which the toner image is directly transferred from the photosensitive drum 50 onto the recording material P as shown in FIG. 14, in many cases, the peripheral length of the recording material conveying member 201 is very longer than the sheet interval length. Therefore, the back contamination of the recording material P generated after the rotation of the recording material conveying member 201 through about ½ turn to one full turn is not always led to the back contamination of the recording material P immediately after the sheet interval. However, the occurrence mechanism of the back contamination of the recording material P can be described similarly as in the cases of the above-described embodiments or the case of the image forming apparatus shown in FIG. 13. Therefore, the present invention is applied to also the image forming apparatus, so that a similar effect can be obtained. In the image forming apparatus, the recording material conveying member 201 is a rotatable transfer member for transferring the toner (member) from the photosensitive drum 50 onto the recording material P while nip-feeding the recording material P at the transfer portion N between itself and the photosensitive drum 50.

In this case, the CPU as the control means, included in the image forming apparatus can control the sheet interval patch formation timing similarly as in the case of the image forming apparatus of FIG. 13 described above.

An example in which the present invention is applied to the image forming apparatus of the direct transfer type (system) will be described more specifically. For example, the case where the sheet interval patch is formed on the photosensitive drum 50K in the station SK for black and is detected by a density sensor 90K on the photosensitive drum 50K will be considered. The patch formed on the photosensitive drum 50K passes through a transfer portion NK, without being transferred onto the recording material conveying member 201, by applying, to the transfer roller 54, a bias (reverse bias) of an opposite polarity (identical to the normal charge polarity of the toner) to that during the image formation. Thereafter, this patch on the photosensitive drum 50K is removed and collected from the photosensitive drum 50K by a drum cleaning device 55K. However, a part of the toner of the patch formed on the photosensitive drum 50K is deposited physically on the recording material conveying member 201 to result in the toner contamination on the recording material conveying member 201 in some cases. Further, in the case of employing a belt cleaner-less system or in the like case, this toner contaminant is then deposited on the back side of the recording material P carried on the recording material conveying member 201 in some cases.

In the belt cleaner-less system, the toner on the recording material conveying member 201 is collected in the drum cleaning device 50 without being removed and collected by a dedicated cleaning blade for the recording material conveying member 201. In the belt cleaner-less system, the toner is transferred from the recording material conveying member 201 onto the photosensitive drum 50 by an electrical action by applying the reverse bias to the transfer roller 54 and/or a physical action by a difference in peripheral speed between the photosensitive drum 50 and the recording material conveying member 201. Then, the toner transferred on the photosensitive drum 50 is removed and collected from the photosensitive drum 50 by the drum cleaning device 55. Further, the toner on the recording material conveying member 201 can be transferred onto the photosensitive drum 50 in a single station (e.g., the upstreammost station) or onto the photosensitive drums 50 in the plurality of the stations.

As described above, the toner contamination on the recording material conveying member 201 is deposited on the back side of the recording material P carried on the recording material conveying member 201 after the rotation of the recording material conveying member 201 through about ½ turn to one full turn. For that reason, this recording material P is not always the recording material P onto which the image immediately after the sheet interval where the sheet interval patch causing the toner contamination is formed. However, similarly as in the cases of the above-described embodiments, in the case where the recording material P carried and conveyed to the position of the toner contamination on the recording material conveying member 201 in the recording material P on which the image has already been formed on its first side, contamination due to the deposition of the toner contamination on the first side image is liable to become conspicuous.

Therefore, in this case, the CPU as the control means, included in the image forming apparatus, for controlling an operation for forming the test image of the toner in the sheet interval region between consecutive output images on the image bearing member can control the sheet interval patch formation timing in the following manner. That is, in the case where the recording material P carried on the recording material conveying member 201 at the position where the recording material conveying member 201 contacted the sheet interval patch is the recording material P onto which the toner in image is to be transferred at the second side during a period from passing of a position of the sheet interval patch in the sheet interval through the transfer portion NK until the recording material conveying member 201 is rotated through a predetermined number of turns is the recording material P on which second side the toner image is to be transferred, formation of the sheet interval patch in the sheet interval is prevented. The predetermined number of turns in this case is typically one full turn in which the back contamination of the recording material due to the toner contamination on the recording material conveying member 201 but is not limited thereto. In other words, the CPU as the control means prevents the test image formation in the interval region satisfying the following predetermined condition. The predetermined condition is such that the position of the recording material conveying member contacting the interval region on the image bearing member contacts the recording material, carried on the recording material conveying member for transferring the toner image onto the second side of the recording material, after the contact with the image bearing member and during one full turn. On the other hand, in a period from the passing of the position of the sheet interval patch in the sheet interval through the transfer portion NK until the recording material conveying member 201 is rotated through the predetermined number of turns, in the case where the recording material P carried on the recording material conveying member 201 at the position when the recording material conveying member 201 contacted the sheet interval patch is the recording material P onto which the toner image is to be transferred at the first side or in the case where the recording material P is not carried on the recording material conveying member 201 at the position, the formation of the sheet interval patch in the sheet interval is permitted. Similarly as in the above-described case, the predetermined number of turns is typically one full turn but is not limited thereto. In other words, the CPU as the control means permits the test image formation in the interval region satisfying the following predetermined condition. That is, the predetermined condition is such that the position of the recording material conveying member contacting the interval region of the image bearing member contacts the recording material to be carried on the recording material conveying member for transferring the toner image onto the first side or does not contact the recording material after the contact with the image bearing member and during one full turn. Similarly as in the cases of the above-described embodiments, it is also possible to further add a condition for discriminating the go/no-go of the test image formation depending on the first side image information, the environment, the type of the recording material P or the like. Similarly as in the case of the above-described embodiments, in the case where the go/no-go of the test image formation is discriminated on the basis of the image information of the first side image at the predetermined position, the predetermined position may be set as follows. That is, the predetermined position is set at a position of the first side image, of the recording material P to be carried on the recording material conveying member 201 for transferring the toner image onto its second side, contacting the recording material conveying member 201 which contacted the test image.

In the above-described embodiments, the sheet interval patch in the station SK for black is described but the sheet interval patches on the photosensitive drums 50 in other stations may also be similarly considered.

Further, in the above-described embodiments, the back contamination of the recording material generated after the sheet interval patch passes through the secondary transfer portion and then the secondary transfer roller is rotated through one full turn was described. However, depending on the density of the sheet interval patch and the constitution of the image forming apparatus main assembly, the back contamination of the recording material can also be generated over the rotation of the secondary transfer roller through a plurality of turns. The present invention is applicable to not only the back contamination of the recording material generated after the sheet interval patch passes through the secondary transfer portion and then the secondary transfer roller is rotated through one full turn but also the back contamination of the recording material after the rotation of the secondary transfer roller through plural turns.

In the embodiments described above, the constitution in which the intermediary transfer belt is provided and the peripheral length of the secondary transfer roller is somewhat longer than the sheet interval length is described but the present invention is not limited thereto. As described above, in some cases, the back contamination of the paper (recording material) occurs over the rotation of the secondary transfer roller through plural times. For that reason, even in the case where the peripheral length of the secondary transfer roller is shorter than the sheet interval length, the present invention can also be similarly applied.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 218720/2011 filed Sep. 30, 2011, which is hereby incorporated by reference.

What is claimed is:

1. An image forming apparatus comprising:

an image bearing member configured to bear an image with a toner;

a transfer unit configured to transfer the image from said image bearing member onto a recording material;

a conveying unit configured to convey the recording material having the image on a first side thereof to transfer the image onto a second side of the recording material;

a control unit configured to control an operation for forming a test image in an interval region between a first image, formed on said image bearing member, and a second image formed subsequently to the first image on said image bearing member;

wherein said control unit is configured to permit formation of the test image in the image interval region when the second image is an image to be transferred onto a first side of the recording material and configured to prevent formation of the test image in the image interval region when the second image is an image to be transferred onto a second side of the recording material.

2. An apparatus according to claim 1, wherein said control unit prevents the formation of the test image in the interval region when the second image is to be transferred onto a first side of the recording material and when an image transferred on the first side of the recording material, onto the second side of which the second image is to be transferred, satisfy a predetermined condition.

3. An apparatus according to claim 2, wherein said control unit discriminates whether or not the image transferred on the first side of the recording material, onto the second side of which the second image is to be transferred, satisfies the predetermined condition on the basis of whether or not, of the images, an image at a predetermined position where said rotatable transfer member to which the test image is contacted at a position is contacted to the image at the position satisfies the predetermined condition.

4. An apparatus according to claim 2, wherein the predetermined condition is that a toner amount per unit area of the image transferred on the first side of the recording material, onto the second side of which the second image is to be transferred, is a predetermined threshold or more.

5. An apparatus according to claim 1, wherein said control unit prevents the formation of the test image in the interval region, when the second image is the image to be transferred onto a second side of the recording material and when an output of a sensor, provided in said image forming apparatus for detecting a temperature or a humidity, satisfies a predetermined condition.

6. An apparatus according to claim 5, wherein said control unit changes, depending on a detection result of the temperature or the humidity, a threshold for discriminating whether or not the formation of the test image in the interval region should be effected.

7. An apparatus according to claim 6, wherein the threshold is a value corresponding to an amount per unit area of the image, and wherein said control unit increases the threshold with a higher temperature or a higher humidity.

8. An apparatus according to claim 1, wherein said control unit prevents the formation of the test image in the interval region, when the second image is the image to be transferred onto a second side of the recording material and when a type or a surface property of the recording material onto which the output image is to be transferred satisfies a predetermined condition.

9. An apparatus according to claim 8, wherein said control unit changes, depending on a detection result of the type or the surface property of the recording material, a threshold for discriminating whether or not the formation of the test image in the image interval region should be effected.

10. An apparatus according to claim 9, wherein the threshold is a value corresponding to an amount per unit area of the image, and wherein said control unit increases the threshold with higher smoothness.

11. An apparatus according to claim 1, wherein said image forming apparatus is operable in a plurality of image forming modes different in type of the recording material used, and wherein said control unit prevents the formation of the test image in the image interval region, when the second image is the image to be transferred onto a second side of the recording material and when a predetermined image forming mode is selected.

12. An apparatus according to claim 1, wherein said control unit prevents the formation of the test image in the image interval region, when the second image is the image to be transferred onto a second side of the recording material and when an amount of use of said rotatable transfer member satisfies a predetermined condition.

13. An apparatus according to claim 1, wherein a subsequent recording material reaches a position, where the image is to be transferred onto the recording material by said transfer unit, in a period from passing of a position of the test image in the image interval region through the position, where the image is to be transferred onto the recording material by said transfer unit, until said rotatable transfer member is rotated through one full circumference.

14. An apparatus according to claim 1, wherein said image bearing member is a photosensitive drum or an intermediary transfer member onto which the image is to be transferred.

15. An apparatus according to claim 1, further comprising;

a detecting unit configured to detect the test image, wherein said control unit corrects, on the basis of a result detected by said detecting unit, an image forming condition.

16. An apparatus according to claim 1, wherein the test image is a patch for adjusting an image density.

17. An image forming apparatus comprising:

an image bearing member configured to bear an image with a toner;

a recording material carrying member, rotatable in contact with said image bearing member, for carrying and conveying a recording material;

a transfer member for transferring the toner image from said image bearing member onto the recording material carried on said recording material carrying member;

a conveying unit configured to cause the recording material, having the image on a first side thereof, to be carried by said recording material carrying member to transfer the image onto a second side of the recording material;

a control unit configured to control an operation for forming a test image in an image interval region between a first image, formed on said image bearing member, and a second image formed subsequently to the first image on said image bearing member;

wherein said control unit prevents the formation of the test image in the image interval region under a predetermined condition, and wherein the predetermined condition is that a position of said recording material carrying member which contacted said image bearing member in the interval region contacts, in a period from after contacting said image bearing member until said recording material carrying member is rotated through one full turn, the recording material carried by said recording material carrying member to transfer the toner image to the second side of the recording material.

18. An apparatus according to claim 17, further comprising:

a detecting unit configured to detect the test image;

wherein said control unit corrects, on the basis of a result detected by said detecting unit, an image forming condition.

19. An apparatus according to claim 17, wherein the test image is a patch for adjusting an image density.

* * * * *